US007412190B2

(12) United States Patent
Kadota et al.

(10) Patent No.: US 7,412,190 B2
(45) Date of Patent: Aug. 12, 2008

(54) DEVELOPING APPARATUS, PROCESS CARTRIDGE, AND IMAGE FORMING APPARATUS

(75) Inventors: Ichiro Kadota, Tokyo (JP); Kazumi Suzuki, Kanagawa (JP); Hideki Kosugi, Kanagawa (JP); Keisuke Uchida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 78 days.

(21) Appl. No.: 11/450,470

(22) Filed: Jun. 12, 2006

(65) Prior Publication Data

US 2007/0098449 A1 May 3, 2007

(30) Foreign Application Priority Data

Jun. 13, 2005 (JP) ..... 2005-172863
Jun. 20, 2005 (JP) ..... 2005-179819
Jul. 11, 2005 (JP) ..... 2005-202247

(51) Int. Cl.
*G03G 15/08* (2006.01)

(52) U.S. Cl. ..... 399/254; 399/258

(58) Field of Classification Search ..... 399/254, 399/258, 259, 260; 430/105
See application file for complete search history.

(56) References Cited

U.S. PATENT DOCUMENTS 5,842,090 A * 11/1998 Mikawa ..... 399/254 X
5,923,930 A 7/1999 Tsukamoto et al.
6,115,576 A 9/2000 Nakano et al.
6,347,212 B1 2/2002 Kosugi et al.
6,421,516 B1 * 7/2002 Kinoshita et al. ..... 399/254
6,473,585 B2 * 10/2002 Abe et al. ..... 399/254
6,603,943 B2 * 8/2003 Yuuki et al. ..... 399/254 X
6,658,227 B2 12/2003 Oyama et al.
6,721,532 B2 4/2004 Kosugi et al.
6,757,512 B2 6/2004 Miyawaki et al.
6,766,132 B2 * 7/2004 Sakai et al. ..... 399/254 X
6,795,676 B2 9/2004 Kikuchi et al.
6,856,780 B2 2/2005 Kadota et al.
6,941,090 B2 9/2005 Uchida et al.
6,947,682 B2 9/2005 Kosugi et al.

(Continued)

FOREIGN PATENT DOCUMENTS

JP 6-3950 1/1994

(Continued)

*Primary Examiner*—Sandra L Brase
(74) *Attorney, Agent, or Firm*—Oblon, Spivak, McClelland, Maier & Neustadt, P.C.

(57) ABSTRACT

The present invention provides a developing apparatus and an image forming apparatus which are capable of outputting stable images with no surface staining and toner scattering even when an image forming process is repeated over a long time period, or even when image formation is performed after special use conditions in which little toner is consumed have continued over a long time period. An area in which a relationship of 0.6<Vlocal/Vaverage<0.9, where Vaverage is an average flow speed of a developer during one circuit of a developing container and Vlocal is a local flow speed of the developer as it moves through the developing container, is satisfied exists in the developing container, and a negatively charged toner maintains a relationship of $\mu 0$ (t)≧$\mu 1$ (t) between an electrostatic charge distribution peak position $\mu 0$ (t) of toner in an external force imparting developer and an electrostatic charge distribution peak position $\mu 1$ (t) of a replenishing toner, this relationship being measured in a deteriorated toner testing method.

22 Claims, 16 Drawing Sheets

U.S. PATENT DOCUMENTS

| | | | | |
|---|---|---|---|---|
| 7,039,344 | B2 * | 5/2006 | Nishiyama | 399/254 |
| 2004/0058260 | A1 | 3/2004 | Katoh et al. | |
| 2004/0126148 | A1 | 7/2004 | Iwai et al. | |
| 2005/0152707 | A1 | 7/2005 | Suzuki et al. | |
| 2005/0238380 | A1 | 10/2005 | Iijima et al. | |
| 2005/0244194 | A1 | 11/2005 | Uchida et al. | |
| 2005/0254846 | A1 | 11/2005 | Yura et al. | |
| 2006/0013604 | A1 | 1/2006 | Kadota et al. | |
| 2006/0072943 | A1 | 4/2006 | Suzuki et al. | |

FOREIGN PATENT DOCUMENTS

| | | |
|---|---|---|
| JP | 7-175309 | 7/1995 |
| JP | 9-106161 | 4/1997 |
| JP | 9-197833 | 7/1997 |
| JP | 10-39592 | 2/1998 |
| JP | 10-149007 | 6/1998 |
| JP | 10-198089 | 7/1998 |
| JP | 11-202573 | 7/1999 |
| JP | 11-202627 | 7/1999 |
| JP | 11-231625 | 8/1999 |
| JP | 2001-154471 | 6/2001 |
| JP | 2001-242688 | 9/2001 |
| JP | 2002-365911 | 12/2002 |
| JP | 2003-66698 | 3/2003 |
| JP | 2003-76059 | 3/2003 |
| JP | 2003-149850 | 5/2003 |
| JP | 2003-228189 | 8/2003 |
| JP | 2004-117387 | 4/2004 |
| JP | 2004-272017 | 9/2004 |

* cited by examiner

POSITION DURING ONE CIRCUIT OF DEVELOPMENT UNIT

A : TONER REPLENISHING POSITION

B : TRANSFER PORTION

FIG. 13

| | Vlocal/Vaverage VALUE | DEVELOPER TYPE | TORQUE RATIO |
|---|---|---|---|
| EXAMPLE 1 | 0.62 | A | 0.51 |
| EXAMPLE 2 | 0.62 | A | 0.59 |
| COMPARATIVE EXAMPLE 1 | 0.62 | B | 0.51 |
| COMPARATIVE EXAMPLE 2 | 0.62 | B | 0.59 |
| COMPARATIVE EXAMPLE 3 | 1.00 | A | 0.71 |
| COMPARATIVE EXAMPLE 4 | 1.00 | A | 0.77 |
| COMPARATIVE EXAMPLE 5 | 1.00 | B | 0.71 |
| COMPARATIVE EXAMPLE 6 | 1.00 | B | 0.77 |

FIG. 14

| | IN-PLANE | TIME | SURFACE STAINING | REPLEN-ISHMENT | REMARKS |
|---|---|---|---|---|---|
| EXAMPLE 1 | ○ | ○ | ○ | ○ | LONG-TERM HIGH IMAGE QUALITY MAINTAINED |
| EXAMPLE 2 | ○ | △ | ○ | ○ | SLIGHT REDUCTION IN DENSITY OVER TIME, BUT STABLE |
| COMPARATIVE EXAMPLE 1 | × | × | × | × | REDUCTION IN-PLANE STABILITY OVER TIME, STAINING OCCURS OVER TIME |
| COMPARATIVE EXAMPLE 2 | × | × | ○ | ○ | LARGE IRREGULARITY IN IN-PLANE DENSITY, IMAGE QUALITY DETERIORATES |
| COMPARATIVE EXAMPLE 3 | △ | × | × | × | LARGE DENSITY UNEVENNESS, SURFACE STAINING PARTICULARLY STRIKING DURING REPLENISHMENT |
| COMPARATIVE EXAMPLE 4 | △ | △ | × | × | SURFACE STAINING STRIKING DURING REPLENISHMENT |
| COMPARATIVE EXAMPLE 5 | × | × | × | △ | UNSTABLE DENSITY, SURFACE STAINING NOTICEABLE OVER TIMER |
| COMPARATIVE EXAMPLE 6 | × | × | △ | ○ | IN-PLANE SOLD DENSITY UNSTABLE OVER TIME |

DEVELOPING APPARATUS, PROCESS CARTRIDGE, AND IMAGE FORMING APPARATUS

BACKGROUND OF THE INVENTION

1. Field of the Invention

The present invention relates to an image forming apparatus using an electro photo graphic process, such as a copying apparatus, a printer, a facsimile apparatus, a plotter, and a composite device thereof, and more particularly to a developing apparatus used in such an image forming apparatus.

2. Description of the Background Art

In accordance with recent demands for reductions in the size of this type of image forming apparatus for enhanced personal use, the size of the developing apparatus used in the image forming apparatus has also been reduced. These demands have also led to the wide use of apparatuses such as disposable developing apparatuses which are exchanged in their entirety when the toner runs out, and process cartridges in which the developing apparatus is integrated with a photosensitive body serving as a latent image carrier on which an electrostatic latent image of an original image is formed, a cleaning apparatus for removing residual toner from the photosensitive body, and so on. However, these small developing apparatuses are disadvantaged in that the amount of developer, comprising a toner and a carrier, that can be stored is small.

Moreover, the amount of space for a developer stirring unit for stirring the developer must also be reduced, and hence the amount of time required for replenishing toner to reach the developing area is shortened. As a result, the toner and magnetic carrier are not stirred sufficiently, leading to a reduction in the charge of the toner and the likelihood of floating toner. When floating toner is generated, surface staining of the transfer paper becomes striking, which is undesirable. This phenomenon occurs particularly when an original having a high image area ratio is printed continuously such that a large amount of replenishing toner is required and the replenishing toner is not dispersed and charged sufficiently.

Further, as image forming apparatuses increase in speed, the rotation speed of the developer stirring member also increases, and since the toner is constituted by minute particles of approximately 3 to 12 μm, a part of the replenishing toner is not stirred sufficiently with the developer, causing the toner to scatter, float, or slide along the surface of the developer. If the toner is then conveyed to the developing area by a developing roller, the uncharged, oppositely charged, or weakly charged toner causes staining on the non-image portion, density unevenness, and toner scattering.

To solve these problems, Japanese Unexamined Patent Application Publication H6-3950 (referred to as Prior Art 1 hereafter), for example, proposes a method of providing means for driving a stirring member independently such that the rotation speed of the stirring member can be varied independently during toner replenishment.

Further, Japanese Unexamined Patent Application Publication H10-198089 (referred to as Prior Art 2 hereafter) proposes a method of varying the stirring conditions of stirring means in accordance with the toner concentration level of the developer, which defines the relationship between an electrostatic charge distribution of the toner at the inlet to a developer stirring unit immediately after toner replenishment, and the amount of a weakly charged and/or oppositely charged toner component in the electrostatic charge distribution of the toner immediately before the outlet of the developer stirring unit following passage through the developer stirring unit.

Further, Japanese Unexamined Patent Application Publication H9-106161 (referred to as Prior Art 3 hereafter) proposes a technique of providing a scattering prevention member for preventing replenishing toner supplied from a toner replenishment unit from sliding over the surface of the developer and being conveyed uncharged to a screw portion on a developing roller side.

Further, Japanese Unexamined Patent Application Publication H11-202573 (referred to as Prior Art 4 hereafter) proposes a technique of raising the electrostatic charge by operating a developer path regulating member of a developing apparatus to approach a developing roller.

Further, Japanese Unexamined Patent Application Publication 2004-272017 (referred to as Prior Art 5 hereafter) proposes a constitution for varying the developer level between an upstream side and a downstream side of a replenishment side stirring chamber by providing more fins on the downstream side of a screw of the replenishment side stirring chamber than the upstream side.

However, with the techniques disclosed in Prior Art 1 and Prior Art 2, changes in the state of the developer caused by repetition of the image formation process are not taken into account, and hence the effects are insufficient. Following an investigation performed by the four present inventors and so on, it was found that following long-term repetition of the image formation process or in special use situations, for example when an original having a high image area is copied after image formation consuming a small amount of toner, such as continuous conveyance of white paper or an original having a low image area, has been performed over a long time period, the effects of Prior Art 1 and Prior Art 2 are not sustained.

Moreover, Prior Art 2 confirms that the behavior of the toner charge consists of both charge and discharge, and that the toner does not always change in one direction. Hence, the effects of Prior Art 2 may be insufficient according to use conditions and environmental conditions.

With the technique disclosed in Prior Art 3, of the two conditions that must be satisfied before the toner is conveyed to the developing unit, namely toner dispersal and toner charging, emphasis is placed on even toner dispersal. In other words, the screw portion is provided with a function for dispersing the replenishing toner into the developer evenly, while toner charging is handled by a conventional method of having the developer slide frictionally along a developer regulating blade. In this type of developing system, the toner receives a large load at a developer gathering portion on the rear side of the developer regulating blade, leading to deterioration of the developer. Deteriorated toner is likely to become weakly charged or oppositely charged, and hence when the image formation process is repeated over a long time period, the electrostatic charge distribution is broadened, leading to surface staining and toner scattering. However, when the stress on the rear of the developer regulating blade is simply reduced, the toner may not be charged sufficiently, causing even more surface staining and toner scattering.

With the technique disclosed in Prior Art 4, the frictional sliding force applied to the developer increases, but the developer regulating location is in the vicinity of a doctor blade, and when the toner is not completely dispersed before being conveyed to this position, concentration unevenness may occur despite the use of the developer regulating means.

All of the techniques disclosed in Prior Art 1 to Prior Art 5 are insufficient in preventing surface sliding of the replenishing toner, achieving even toner dispersal, performing toner charging adequately, and increasing the life of the developer by weakening the mechanical force that is applied conventionally to the developer. Investigations into the material constitution of developer are also currently underway to find ways of improving the charge buildup performance using various charge control agents and external additives. However, as the charge buildup performance improves, irregularities in the charge behavior are generated during toner replenishment.

Technologies relating to the present invention are also disclosed in, e.g. Japanese Unexamined Patent Application H7-175309, Japanese Unexamined Patent Application H10-149007, Japanese Unexamined Patent Application H10-198089, Japanese Unexamined Patent Application H11-202627, Japanese Unexamined Patent Application H11-231625, Japanese Unexamined Patent Application 2001-154471, and Japanese Unexamined Patent Application 2001-242688.

SUMMARY OF THE INVENTION

An object of the present invention is to provide a small developing apparatus represented by a process cartridge in which, when an image formation process is repeated over a long time period, or when image formation is performed after special use conditions in which little toner is consumed have continued for a long time period, a developer exhibits little deterioration, and surface staining or toner scattering does not occur in the long term, as well as an image forming apparatus using this developing apparatus.

According to an aspect, other is provided a developing apparatus in which a magnetic brush is formed by magnetically applying a two-component developer, which is constituted by at least a magnetic carrier and a negatively charged toner comprising toner particles and an external additive, onto a developer carrier. An electrostatic latent image formed on a latent image carrier is made visible by the magnetic brush. The developing apparatus comprises a stirring device for stirring and dispersing the developer and conveying the developer to a predetermined position within a developing container; and a toner replenishing device for replenishing toner that is consumed during development. An area in which a relationship of $0.6<V_{local}/V_{average}<0.9$, where Vaverage is an average flow speed of the developer during one circuit of the developing container and Vlocal is a local flow speed of the developer as the developer moves through the developing container, is satisfied exists in the developing container. The negatively charged toner maintains a relationship of $\mu_0(t) \geqq \mu_1(t)$ between an electrostatic charge distribution peak position $\mu_0(t)$ of toner in an external force imparting developer and an electrostatic charge distribution peak position $\mu_1(t)$ of the replenishing toner. The relationship is measured in a deteriorated toner testing method.

According to another aspect of the invention, there is provided a developing apparatus which comprises a stirring device for stirring and dispersing a two-component developer constituted by a toner and a carrier using two rotatable screws disposed within a developer container, and conveying the two-component developer to a predetermined position; and a toner replenishing device for replenishing toner that is consumed during development. When a developer storage portion on a toner replenishment side is set as a replenishment side stirring chamber and a developer storage portion on a side facing a developer carrier is set as a development side stirring chamber. A flow speed V1 from a downstream end-portion of the replenishment side stirring chamber to a position directly after transfer into the development side stirring chamber and an average flow speed V2 of the developer during one circuit of the developer container satisfy a relationship of $0.6<V_1/V_2<1$.

According to another aspect of the invention, there is provided a developing apparatus which comprises a stirring device for stirring and dispersing a two-component developer constituted by a toner and a carrier using two rotatable screws disposed within a developer container, and conveying the two-component developer to a predetermined position; a toner replenishing device for replenishing toner that is consumed during development; a toner concentration detecting device for detecting a toner concentration of the developer; and an image density detecting device for detecting an image density of a reference toner image formed on an image carrier surface formed with an electrostatic latent image. When a developer storage portion on a toner replenishment side is set as a replenishment side stirring chamber and a developer storage portion on a side facing a developer carrier is set as a development side stirring chamber, developer transmission regulating devices are provided at an opening portion through which the developer is transferred from a downstream end portion of the replenishment side stirring chamber in a developer conveyance direction into the development side stirring chamber. Drive control devices are provided for activating the developer transmission regulating device when the toner concentration of the developer is detected to be equal to or greater than a predetermined value by the toner concentration detecting device and the image density of the reference toner image is detected to have fallen below a predetermined level by the image density detecting device, whereby a flow speed V1 from a downstream end portion of the replenishment side stirring chamber to a position directly after transfer into the development side stirring chamber and an average flow speed V2 of the developer during one circuit of the developer container satisfy a relationship of $0.6<V_1/V_2<1$.

According to another aspect of the invention, there is provided a developing apparatus which comprises a stirring device for stirring and dispersing a two-component developer constituted by toner particles and carrier particles using two rotatable screws disposed within a developer container, and conveying the two-component developer to a predetermined position; and a toner replenishing device for replenishing toner that is consumed during development. When a developer storage portion on a toner storage side is set as a replenishment side stirring chamber, a developer storage portion on a side facing a developer carrier is set as a development side stirring chamber, an average flow speed of the developer during one circuit of the developer container is set as Vaverage, and a local flow speed of the developer as the developer moves through the developing container is set as Vlocal, a slow flow path on which a relationship of $0.6<V_{local}/V_{average}<0.9$ is established exists within the developing container.

BRIEF DESCRIPTION OF THE DRAWINGS

The above and other objects, features, and advantages of the present invention will become more apparent from the following detailed description taken with the accompanying drawings in which:

FIG. 13 is a table showing the results of an evaluation of long-term image stability;

FIG. 14 is a table showing the results of an evaluation of stability during toner replenishment;

DESCRIPTION OF THE PREFERRED EMBODIMENTS

Embodiments of the present invention will be described in detail below.

First Embodiment

Figure 1:
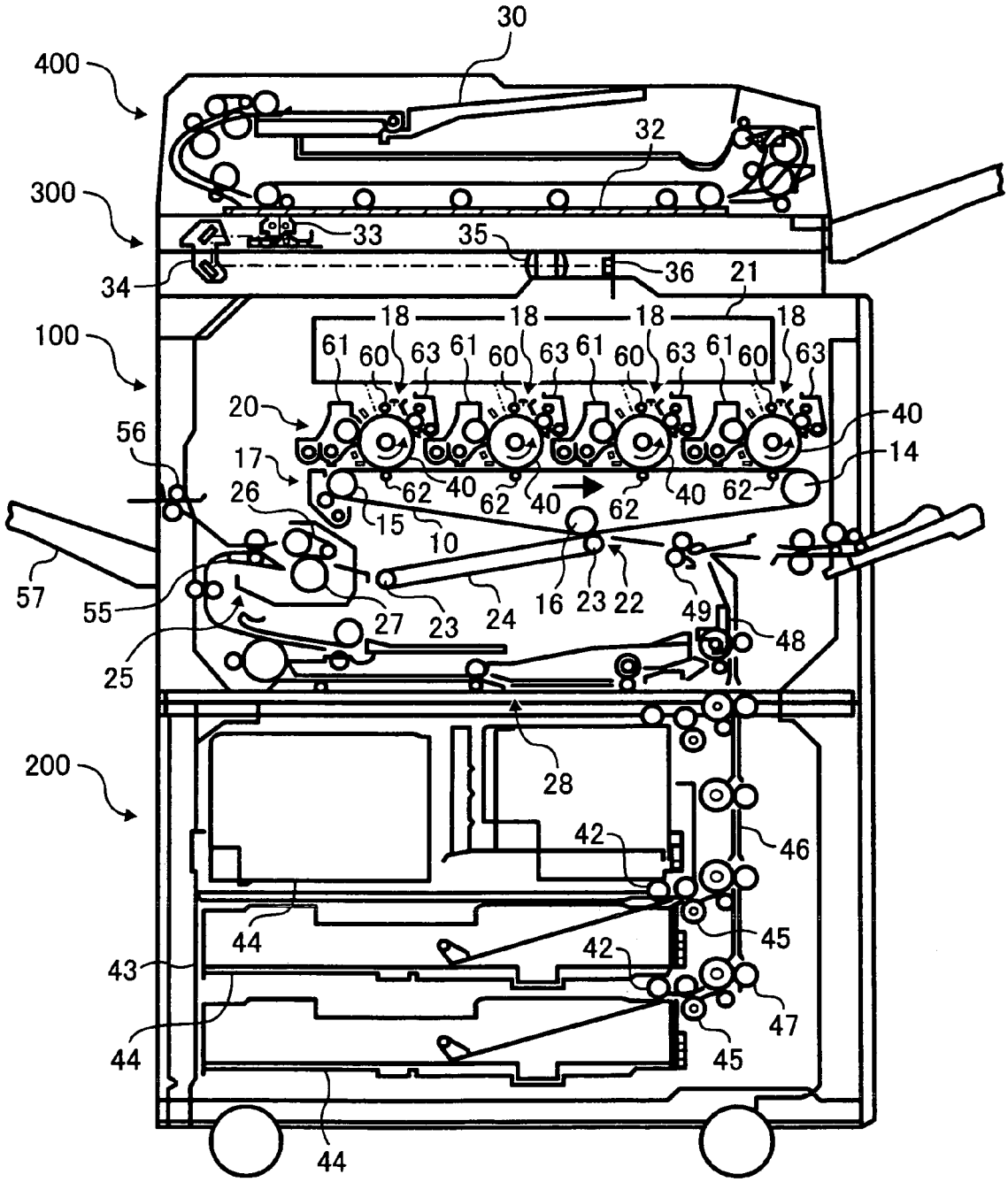
FIG. 1 is a front view showing the schematic constitution of an image forming apparatus according to a first embodiment of the present invention.

FIG. 1 shows a color image forming apparatus serving as an image forming apparatus according to the first embodiment. In this embodiment, an example using a tandem type indirect transfer electrophotographic copying apparatus as an image forming apparatus will be described, but the present invention is not limited to this type of image forming apparatus, and may be applied to all image forming apparatuses using an electrophotographic method realized by a two-component developer.

In FIG. 1, the reference numerals 100, 200, 300, and 400 denote a copying apparatus main body, a paper feeding table on which the copying apparatus main body 100 is placed, a scanner serving as a reading optical system mounted on the upper portion of the copying apparatus main body 100, and an ADF serving as an automatic original conveyance apparatus mounted on the upper portion of the scanner 300, respectively.

An intermediate transfer body 10 in an endless belt form extending in the horizontal direction of FIG. 1 is disposed substantially in the center of the copying apparatus main body 100. The intermediate transfer body 10 is wrapped around three support rollers 14, 15, 16 which rotate, and thereby convey, the intermediate transfer body 10 in the clockwise direction of FIG. 1. An intermediate transfer body cleaning apparatus 17 for removing residual toner from the top of the intermediate transfer body 10 following an image transfer operation is disposed to the left of the support roller 15.

A tandem image forming unit 20 having image forming means 18 for each of four colors—black, yellow, magenta, and cyan—provided in series in the conveyance direction of the intermediate transfer body 10 is disposed above the intermediate transfer body 10 between the support rollers 14, 15. An exposure apparatus 21 is disposed above the tandem image forming unit 20.

A secondary transfer apparatus 22 is disposed in a position facing the tandem image forming unit 20 via the intermediate transfer body 10. The secondary transfer apparatus 22 is constituted by wrapping an endless belt serving as a secondary transfer belt 24 around two rollers 23, and is disposed so as to press the secondary transfer belt 24 against the support roller 16 via the intermediate transfer body 10 such that an image on the intermediate transfer belt 10 is transferred onto a sheet. The secondary transfer apparatus 22 also has a sheet conveyance function for conveying the sheet to a fixing apparatus 25, to be described below, following image transfer.

The fixing apparatus 25 for fixing the image transferred onto the sheet is disposed to the left of the secondary transfer apparatus 22. The fixing apparatus 25 comprises an endless belt serving as a fixing belt 26 and a pressure roller 27 pressed against the fixing belt 26. A sheet reversing apparatus 28 for reversing the sheet so that an image can be recorded on both sides of the sheet is disposed below the fixing apparatus 25 in parallel with the tandem image forming unit 20.

In the tandem image forming unit 20, each image forming means 18 comprises a charging apparatus 60, a developing apparatus 61, a primary transfer apparatus 62, a photosensitive body cleaning apparatus 63, a neutralization apparatus not shown in the drawing, and so on, which are disposed around a drum-shaped photosensitive body 40 serving as a latent image carrier.

Figure 2:
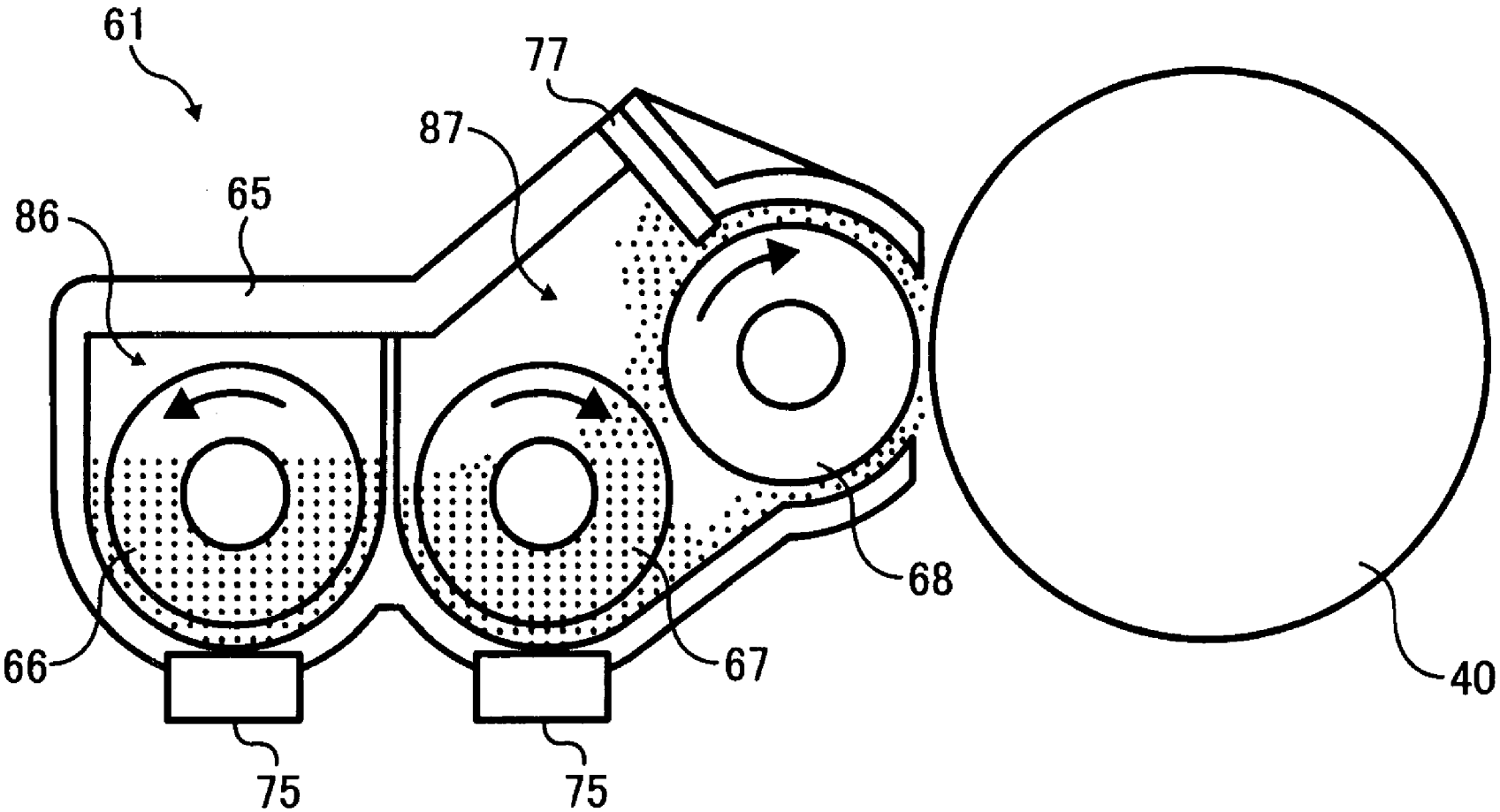
FIG. 2 is a view showing the schematic constitution of a developing apparatus used in this embodiment.

As shown in FIG. 2, the developing apparatus 61 comprises within a developing container 65 a replenishment side stirring screw 66 and a development side stirring screw 67, both of which serve as developer stirring and conveyance means, a developing roller 68 serving as a developer carrier, and a doctor blade 77. The replenishment side stirring screw 66 is disposed in a replenishment side stirring chamber 86, and the development side stirring screw 67 is disposed within a development side stirring chamber 87. A replenishment port, not shown in the drawing, through which replenishing toner is supplied from a toner replenishment apparatus, also not shown in the drawing, is provided in an outer container wall of the replenishment side stirring chamber 86. The replenishment side stirring screw 66 stirs and conveys the replenishing toner supplied from the toner replenishment apparatus and a two-component developer in the developing container 65, while the development side stirring screw 67 stirs and conveys the two-component developer in the developing container 65.

Figure 3:
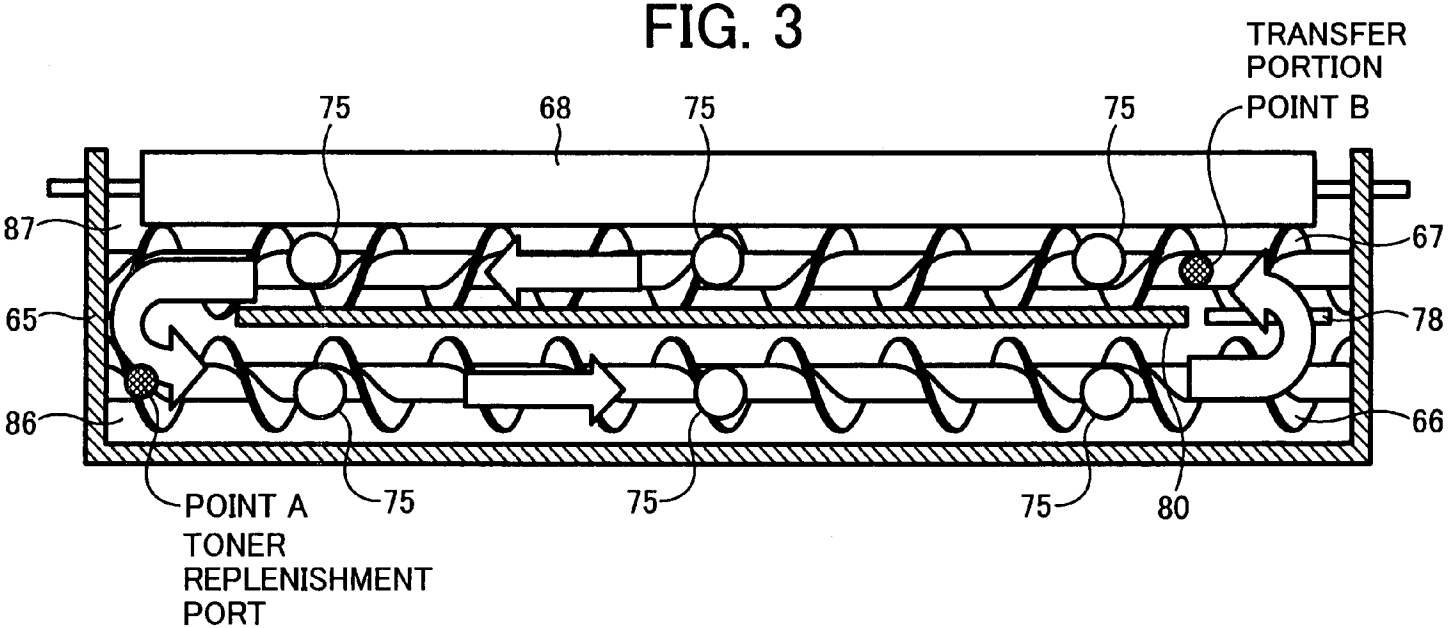
FIG. 3 is a view illustrating a developer flow in this developing apparatus.

As shown in FIG. 3, a partition plate 80 is disposed between the replenishment side stirring chamber 86 and development side stirring chamber 87 for partitioning the two. The two end portions of the partition plate 80 are separated from the developing container 65, and an opening portion is formed in the separated portion to transfer the developer between the replenishment side stirring chamber 86 and development side stirring chamber 87. The developer in the development side stirring chamber 87 is drawn up by the developing roller 68 and supplied to a frictional sliding portion with the photosensitive body 40 while the layer thickness thereof is regulated by the doctor blade 77. At this time, a maximum frictional sliding force is applied to the developer by the doctor blade 77. In FIGS. 2 and 3, the reference numeral 75 denotes a plurality of toner concentration sensors.

Figure 4:
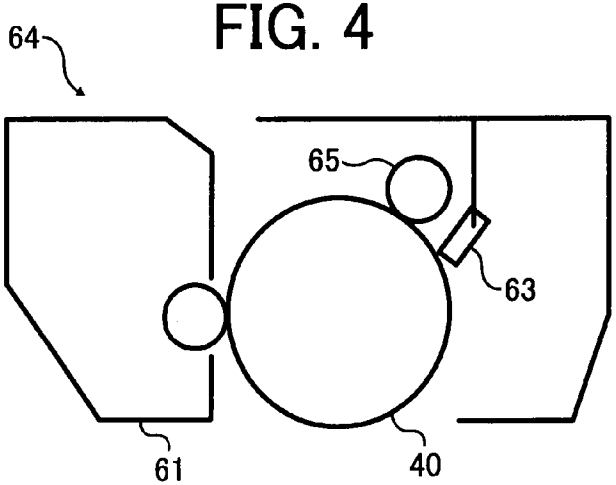
FIG. 4 is a view showing the schematic constitution of a process cartridge used in this embodiment.

The above copying apparatus of the present invention is constituted such that the photosensitive body 40, charging apparatus 60, developing apparatus 61, and photosensitive body cleaning apparatus 63 are disposed independently of one another. However, a plurality of these constitutional elements may be joined integrally as a process cartridge 64, as shown in FIG. 4, and the process cartridge 64 may be constituted to be freely attachable to the copying apparatus main body 100.

In an image forming apparatus comprising the process cartridge 64, the photosensitive body 40 is driven to rotate at a predetermined circumferential speed. During this rotation process, the peripheral surface of the photosensitive body 40 is evenly charged with a positive or negative predetermined potential by the charging apparatus 60, and then receives image exposure light from the exposure apparatus 21 by means of slit exposure, laser beam scanning exposure, or similar. As a result, an electrostatic latent image is formed on the peripheral surface of the photosensitive body 40, and the formed electrostatic latent image is transformed into a toner image in the developing apparatus 61. Following the transfer operation, the photosensitive body cleaning apparatus 63 removes residual toner to clean the photosensitive body 40, whereupon the photosensitive body 40 is neutralized by a neutralizing apparatus, not shown in the drawing, in preparation for the next image formation process.

An operation performed during image formation using the above color image forming apparatus will now be described.

An original to be subjected to image formation is set on an original table 30 of the ADF 400, or the ADF 400 is opened, the original is set on a contact glass 32 of the scanner 300, and the ADF 400 is closed. A start switch, not shown in the drawing, is then pressed by an operator. When the original is set on the ADF 400, the ADF 400 then conveys the original onto the contact glass 32, whereupon the scanner 300 is driven. When the original is set on the contact glass 32, the scanner 300 is driven immediately. A first traveling body 33 and a second traveling body 34 provided in the scanner 300 are operated when the scanner 300 is driven. The first traveling body 33 emits light from a light source and reflects reflection light from the surface of the original toward the second traveling body 34. Information reflected by a mirror of the second traveling body 34 is input into a read sensor 36 via an imaging lens 35, and thus the original image is read.

Further, when the start switch not shown in the drawing is depressed, a motor, not shown in the drawing, is activated to drive one of the support rollers 14, 15, 16 to rotate, whereby the intermediate transfer body 10 is rotated and the photosensitive body 40 in each of the image forming means 18 is driven to rotate. As a result, monochrome images in black, yellow, magenta, and cyan are formed on the respective photosensitive bodies 40. The formed monochrome images are transferred in sequence onto the intermediate transfer body 10 while the intermediate transfer body 10 rotates by operating each of the primary transfer apparatuses 62, and thus a synthesized color image is formed on the intermediate transfer body 10.

Meanwhile, when the start switch not shown in the drawing is depressed, one of a plurality of paper feed rollers 42 disposed in the paper feeding table 200 is selected and driven to rotate, whereby sheets are fed from one of a plurality of multi-stage paper feeding cassettes 44 provided in a paper bank 43. The fed sheets are separated into individual sheets by a separating roller 45, conveyed onto a paper feed path 46, and conveyed by a conveyance roller 47 to a paper feed path 48 within the copying apparatus main body 100. The sheet is then temporarily halted at a nip portion of a resist roller pair 49. The resist roller pair 49 then rotate in alignment with the synthesized color image on the intermediate transfer body 10, whereby the sheet is conveyed between the intermediate transfer body 10 and the secondary transfer apparatus 22. By activating the secondary transfer apparatus 22, the synthesized color image is transferred onto the sheet.

The sheet on which the image has been transferred is conveyed to the fixing apparatus 25 by the secondary transfer apparatus 22, and in the fixing apparatus 25, heat and pressure are applied to the sheet to fix the transferred synthesized color image on the sheet. The image-fixed sheet is then guided by a switching claw 55 to a discharge roller 56, discharged to the exterior of the copying apparatus main body 100 by the discharge roller 56, and placed on a delivery tray 57. Alternatively, the sheet is guided by the switching claw 55 to the sheet reversing apparatus 28, reversed, conveyed back to the transfer position where an image is recorded on its rear surface, conveyed to the discharge roller 56, and placed on the delivery tray 57. Meanwhile, following image transfer, residual toner is removed from the surface of the intermediate transfer body 10 by the intermediate transfer body cleaning apparatus 17 in preparation for subsequent image formation by the tandem image formation unit 20.

The two-component developer (referred to as developer hereafter) in a typical developing apparatus including the developing apparatus 61 described above constantly receives mechanical stress through being stirred, drawn by the developing roller, and so on. It may be said that this stress is necessary to the electrophotographic process for applying an electrostatic charge to the toner, supplying the toner to the development unit, and so on. Moreover, in a developing apparatus having a reduced size, the time that can be applied to toner charging is short, and hence great stress must be applied to the developer. Under such constant mechanical stress, the developer, and particularly the toner therein, undergoes various characteristic changes. Of these toner characteristic changes, variation in the charging characteristic, caused by external additive embedding, and increases in non-electrostatic adhesion have a large effect on surface staining and replenishing toner scattering due to their relationship with the stirring stress of the developing apparatus.

Variation in the charging characteristic under a change of state caused by mechanical stress on the developer can be observed particularly strikingly during toner replenishment. When the replenishing toner supplied to the developer is dispersed throughout the developer sufficiently, the charge is distributed among the replenishing toner and the toner existing in the developer via a carrier in the developer such that the developer toner and the replenishing toner have electrostatic charge distributions corresponding to the respective external additive embedding states thereof, there by achieving a temporary state of equilibrium. This state of equilibrium varies according to the stirring conditions.

A method of measuring the electrostatic charge distribution of the toner will now be described.

Known methods of measuring the electrostatic charge distribution of toner include a method employing the charge spectrum method and a method using a laser Doppler speedometer. Any measurement method may be used, but in this embodiment, a method of measuring the electrostatic charge distribution of the toner in a toner particle charge distribution measurement apparatus (E-Spart analyzer; manufactured by Hosokawa Micron Corporation) using a laser Doppler speedometer will be described.

First, a developer is held on a developer holding table constituted by a magnet. Next, the developer held on the developer holding table is separated into a magnetic carrier and toner by an air gun (nitrogen gas), whereupon the toner particles alone are introduced into a measurement unit by suction. The toner introduced by suction into the measurement unit is subjected to sequential electrostatic charge measurement, whereby the electrostatic charge distribution of the toner is obtained. The measurement conditions in this embodiment are as follows.

Nitrogen gas blowing pressure: 0.4 kg/cm$^2$G

Nitrogen gas blowing time: 2sec

Nitrogen gas blowing interval: 2sec

Rotation speed of developer holding table:

150 r.p.m

Figure 5:
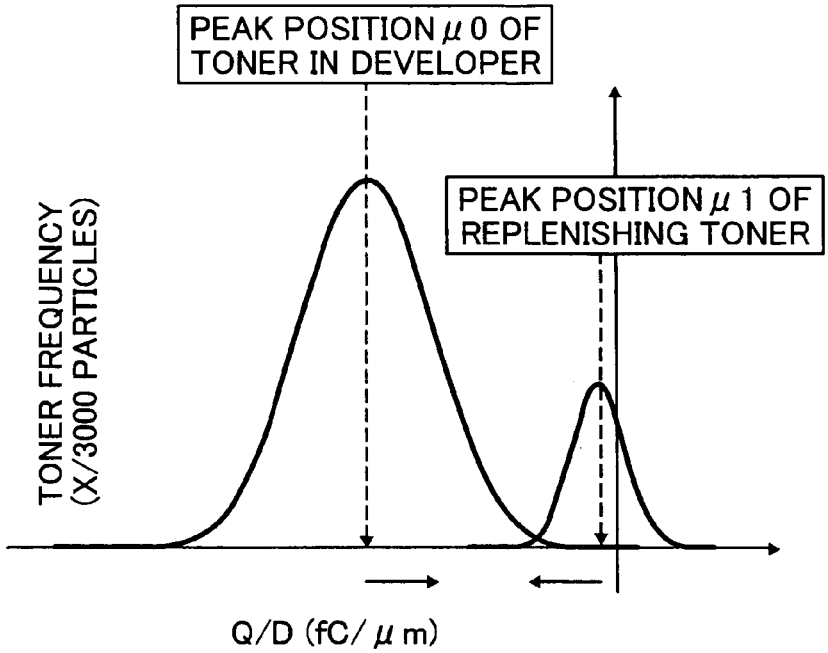
FIG. 5 is a diagram showing a charge distribution immediately after replenishment of a toner used in this embodiment.

FIG. 5 is a diagram of the electrostatic charge distribution of the toner immediately after toner replenishment. An electrostatic charge distribution peak position of the developer toner is denoted by μ0, and an electrostatic charge distribution peak position of the replenishing toner is denoted by μ1. The abscissa shows a value obtained by dividing a toner charge Q by a toner particle diameter D, and the ordinate shows the toner amount.

The electrostatic charge distribution peak position is the abscissa value (Q/D) corresponding to the position at which the frequency of the value on the ordinate is highest. During a stirring time t, the electrostatic charge distribution peak position μ0 (t) of the developer toner and the electrostatic charge distribution peak position μ1 (t) of the replenishing toner gradually draw nearer to one another as stirring progresses, and when the charging characteristic deteriorates due to mechanical stress on the developer toner, the two temporarily merge in a state where μ0 (t)>μ1 (t). The difference between μ0 (t) and μ1 (t) decreases as long as the developer is not exposed to mechanical stress, or when the developer is such that its charging characteristic is little changed by mechanical stress, so the difference cannot be recognized clearly due to the overlapping distributions, but as deterioration of the charging characteristic due to mechanical stress on the developer toner increases, the difference between the electrostatic charge distribution peak position of the developer toner and the electrostatic charge distribution peak position of the replenishing toner increases steadily, reaching a maximum when the external additive is completely embedded in the developer.

Figure 6:
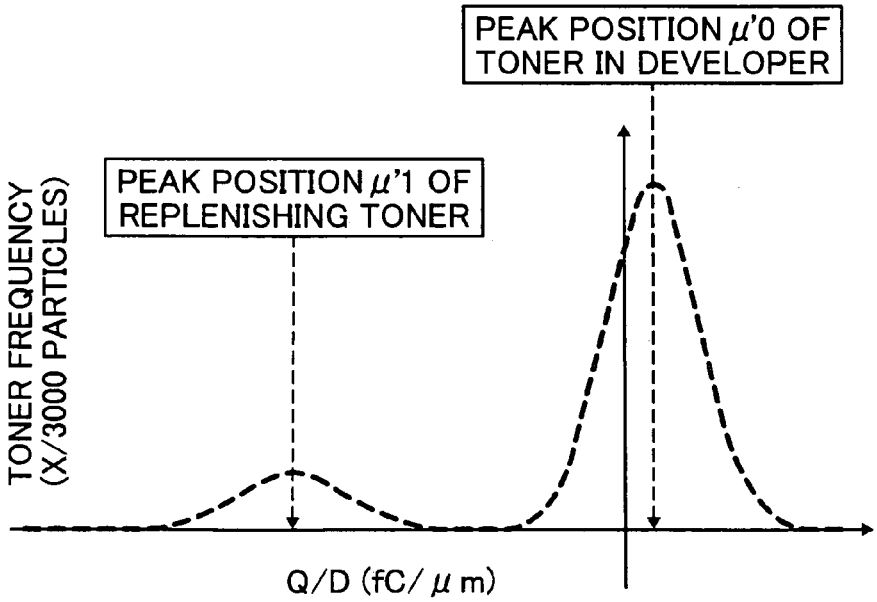
FIG. 6 is a diagram showing an example of an electrostatic charge distribution peak position μ'0 of the toner contained in a developer and an electrostatic charge distribution peak position μ'1 of the replenishing toner when the toner used in this embodiment is in a state of equilibrium.

FIG. 6 shows an example of an electrostatic charge distribution peak position μ'0 of the developer toner and an electrostatic charge distribution peak position μ'1 of the replenishing toner in the state of equilibrium described above. At μ'0, a charge is allotted to the replenishing toner such that the charge decreases. The charge of the replenishing toner increases due to charge allotment from the carrier and the developer toner.

In this embodiment, the electrostatic charge distribution peak position of the toner in an external force imparting developer and the electrostatic charge distribution peak position of the replenishing toner in a state of temporary equilibrium following toner replenishment, measured using the following deteriorated toner testing method, are set as μ'0 and μ'1, respectively. As stirring continues, μ0 (t) and μ1 (t) vary further, gradually converging into a single peak. In the testing method, excessive mechanical stress is applied under the following conditions to create an external force imparting developer which simply reproduces the changes of state of the developer in the developing apparatus.

A magnetic roll stirrer (manufactured by Ricoh Engineering Co., Ltd.) is used to create the external force imparting developer. A magnetic roll stirrer is a stirring apparatus in which a magnet can be attached to the lower portion of a roll mill container so that stirring can be performed while applying a load to the magnetic carrier in the container using the magnetic force of the magnet. 7 g of developer mixed to a toner coverage of 50% is introduced into a magnetic roll sealed container made of stainless steel. The magnetic force for applying a load to the developer is set at 3000 Gauss, and stirring is performed at a rotation speed of 280 r.p.m. 0.1 g of developer is sampled from the container after every ten minutes of stirring, and the external additive condition on the toner surface is observed using an electronic microscope. Stirring continues until the external additive is embedded in the toner surface and can no longer be observed. Thus the external force imparting developer is created.

6 g of the external force imparting developer created by the method described above is introduced into the magnetic roll sealed container. The introduced external force imparting developer is replenished with an equal amount of replenishing toner to the amount of toner already existing in the external force imparting developer, and stirring is performed at a rotation speed of 280 rpm without applying a load through magnetic force. The electrostatic charge distribution is measured at unit time intervals, and thus the electrostatic charge distribution peak position is measured. The electrostatic charge distribution peak position of the external force imparting developer toner during the stirring time t is set at μ0 (t), and the electrostatic charge distribution peak position of the replenishing toner is set at μ1 (t).

Figure 7:
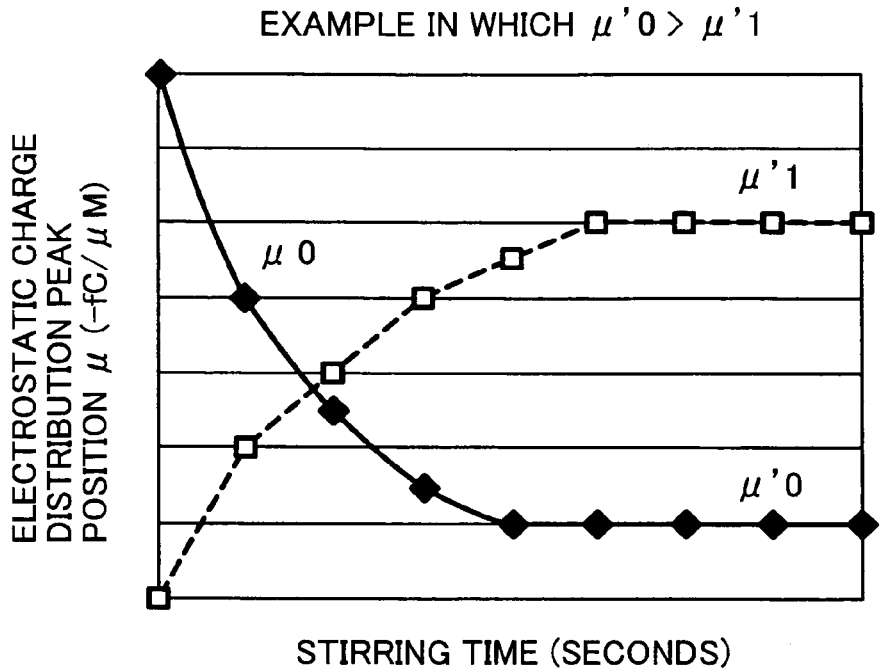
FIG. 7 is a diagram showing an example of variation in the electrostatic charge distribution peak position in relation to the stirring time of the toner used in this embodiment.
Figure 8:
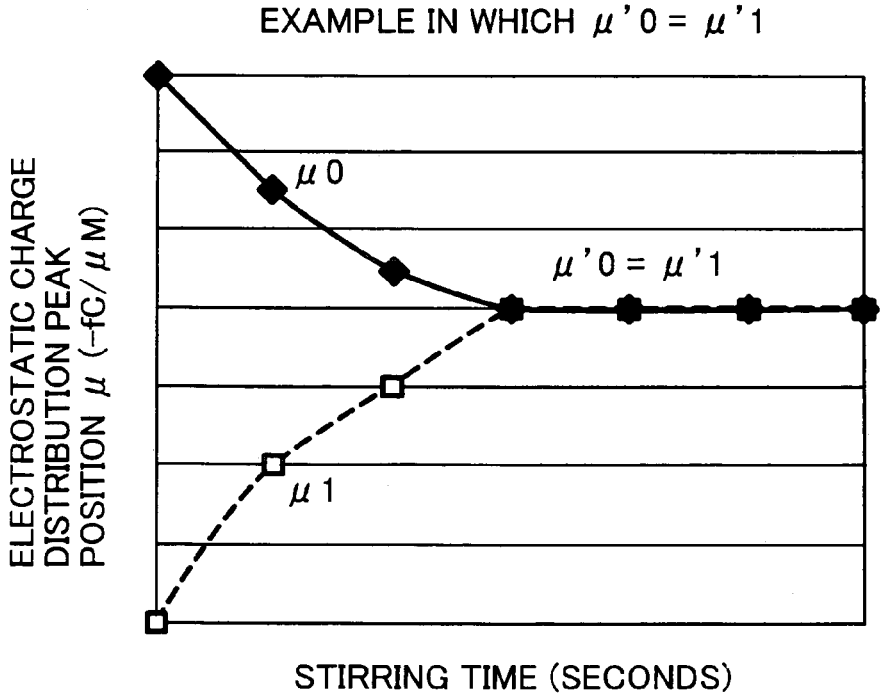
FIG. 8 is a diagram showing an example of variation in the electrostatic charge distribution peak position in relation to the stirring time of the toner used in this embodiment.

FIGS. 7 and 8 show examples of variation in the electrostatic charge distribution peak positions during the stirring time. The behavior of the replenishing toner during electrostatic charge build-up can be observed together with a decrease in the electrostatic charge of the external force imparting developer toner during charge transfer. It can be seen that the respective electrostatic charge distribution peaks converge when the replenishing toner is sufficiently dispersed. The converged electrostatic charge distribution peak position of the external force imparting developer toner is denoted as μ'0, and the converged electrostatic charge distribution peak position of the replenishing toner is denoted as μ'1.

Note that the electrostatic charge distribution peak position μ'0 of the external force imparting developer toner and the converged electrostatic charge distribution peak position μ'1 of the replenishing toner do not indicate the behavior of the electrostatic charge distribution of the toner in the developing apparatus, but are instead considered to express the relationship between the essential electrostatic charge characteristics of the toner in the external force imparting developer and the replenishing toner, i.e. the toner to which no mechanical stress is applied. Further, the relationship between the electrostatic charge distribution peak position μ'0 of the external force imparting developer toner and the converged electrostatic charge distribution peak position μ'1 of there plenishing toner naturally varies according to the mass ratio of the external force imparting developer toner and the replenishing toner, and in the present invention, the relationship between the essential electrostatic charge characteristics of the external force imparting developer toner and the replenishing toner, i.e. the toner to which no mechanical stress is applied, is defined by the mass ratio.

The developer used in this embodiment is such that the electrostatic charge characteristic thereof is not varied greatly by mechanical stress, and thus the magnitude relation between $\mu 0$ (t) and $\mu 1$ (t) does not vary as stirring continues. With a developer having these characteristics, the electrostatic charge build-up of the replenishing toner is necessarily slow, but once the electrostatic charge of the replenishing toner has risen, a stable electrostatic charge distribution is maintained. It has been ascertained that one of the typical causes of a reversal in the magnitude relation between $\mu 0$ (t) and $\mu 1$ (t) in the developer is the effect of an external additive constituted by a combination of an electrostatic charge controlling agent and a resin parent body, but this magnitude relation is believed to be defined by all of the material constitutions of the developer.

The toner used in the development method and developing apparatus of this embodiment is constituted by parent body particles containing at least a resin and a coloring agent and an external additive.

In this case, any resin which is used conventionally as a toner binding resin may be applied. More specifically, a homopolymer containing a styrene such as polystyrene, polychlorostyrene, and polyvinyl toluene and a substitution thereof, a styrene copolymer such as a styrene/p-chlorostyrene copolymer, a styrene/propylene copolymer, a styrene/vinyl toluene copolymer, a styrene/vinyl naphthalene copolymer, a styrene/methyl acrylate copolymer, a styrene/ethyl acrylate copolymer, a styrene/butyl acrylate copolymer, a styrene/octyl acrylate copolymer, a styrene/methyl methacrylate copolymer, a styrene/ethyl methacrylate copolymer, a styrene/butyl methacrylate copolymer, a styrene/methyl α-chlormethacrylate copolymer, a styrene/acrylonitrile copolymer, a styrene/vinyl methyl ether copolymer, a styrene/vinyl ethyl ether copolymer, a styrene/vinyl methyl ketone copolymer, a styrene/butadiene copolymer, a styrene/isoprene copolymer, a styrene/acrylonitrile/indene copolymer, a styrene/maleic acid copolymer, and a styrene/maleate copolymer, polymethyl methacrylate, polybutyl methacrylate, polyvinyl chloride, polyvinyl acetate, polyethylene, polypropylene, polyester, polyvinyl butyl butyral, polyacrylic resin, rosin, modified rosin, terpene resin, phenol resin, an aliphatic or alicylic hydrocarbon resin, an aromatic petroleum resin, chlorinated paraffin, paraffin wax, and so on maybe used either individually or in a mixture of two or more components as the resin. There are no particular limitations on the manufacturing method for the resin, and any of bulk polymerization, solution polymerization, emulsion polymerization, and suspension polymerization may be used.

As the coloring agent, any well-known coloring agent for a toner may be used. As the black coloring agent, carbon black, aniline black, furnace black, lamp black, and so on may be used, for example. As the cyan coloring agent, phthalocyanine blue, methylene blue, victoria blue, methyl violet, aniline blue, ultramarine blue, and so on may be used, for example. As the magenta coloring agent, rhodamine 6G lake, dimethyl quinacridone, watching red, rose bengal, rhodamine B, alizarin lake, and so on may be used, for example. As the yellow coloring agent, chrome yellow, benzine yellow, hansa yellow, naphthol yellow, molybdenum orange, quinoline yellow, tartrazine, and so on may be used, for example.

The toner described above may contain a small amount of charge imparting agent, for example a dye/pigment polarity controlling agent or the like. Examples of the polarity controlling agent include a metal complex of a monoazo dye, nitrohumic acid and nitrohumate, salicylicacid, naphthoicacid; a metal complex, such as Co, Cr, or Fe, of dicarboxylic acid, an organic dye, quarternary ammonium salt, and soon, for example. The charge imparting agent causes variation in $\mu 0$ (t) and $\mu 1$ (t) and the relationship there between, and the amount thereof to be added is defined by the type and mass ratio of the resin and external additive.

There are no limitations on the method of manufacturing the toner particles, and a mixing and grinding method, a polymerization method, or another method may be employed. The particle diameter of the toner particles is preferably between 3 and 12 μm. At less than 3 μm, the effect of non-electrostatic adhesion increases such that the stability of the development, transfer, cleaning, and other processes decreases. With a particle diameter of more than 12 μm, the image quality is greatly reduced.

The inorganic micro particles used as the external additive may be constituted by silica, alumina, titanium oxide, barium titanate, magnesium titanate, calcium titanate, strontium titanate, ironoxide, copperoxide, zincoxide, tinoxide, silica sand, clay, mica, wollastonite, kieselguhr, chromium oxide, cerium oxide, rediron oxide, antimony trioxide, magnesium oxide, zirconium oxide, barium sulfate, barium carbonate, calcium carbonate, silicon carbide, silicon nitrate, and so on, for example. In the present invention, silica and titanium oxide are preferably used. Silica reduces toner non-electrostatic adhesion and suppresses embedding into the parent body particles, and hence at least one of the aforementioned types of inorganic microparticles preferably has a primary average particle diameter of at least 30 nm and at most 150 nm. When the primary average particle diameter is less than 30 nm, embedding into the parent body particles becomes striking during stirring in the unit, and when the primary average particle diameter is greater than 150 nm, the toner dispersal through the developer during replenishment is likely to become uneven due to a lack of toner fluidity. Similarly to the charge imparting agent, titanium oxide causes variation in $\mu 0$ (t) and $\mu 1$ (t) and the relationship there between. Accordingly, the titanium oxide should not have a large number of free components, and an adhesion rate of at least 90% is preferable, and 95% even more preferable.

A method of measuring the additive adhesion rate will now be described.

This method references the methods disclosed in Japanese Unexamined Patent Application Publication H7-199519 and Japanese Unexamined Patent Application Publication 2000-122336. A toner (5.0 g), an activator solution (100 ml of ion-exchanged water, 4.4 ml of an activator dry well), a 200 ml ointment bottle, an ultrasonic homogenizer, a rote, filter paper, a suction pump, ion-exchanged water, a dryer, a mortar, and a pestle are prepared, and fluorescent X-ray measurement is performed in advance on the toner following mixing with an additive.

Figure 9:
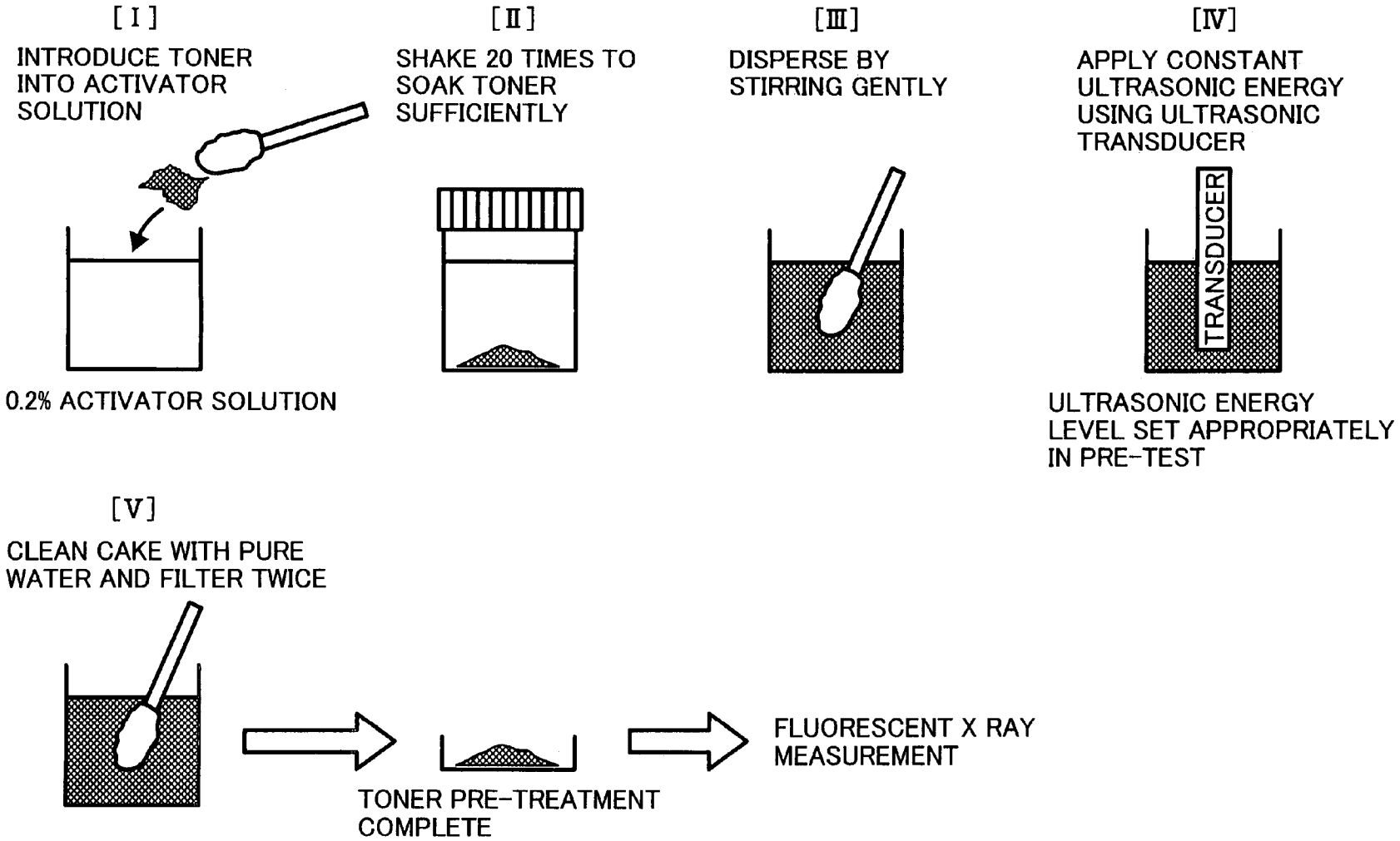
FIG. 9 is a schematic diagram illustrating a method of measuring an additive adhesion rate used in this embodiment.

First, the activator solution and the toner are poured into the 200 ml ointment bottle, a lid is placed on the bottle, and the bottle is shaken vertically twenty times to mix the two. The mixture is then left for 1.5 to 3 hours, and then irradiated by the ultrasonic homogenizer (UH-30, 24 kHz) for one minute. Suction and filtering are then performed, whereupon cleaning is performed twice using the ion-exchanged water. The toner is then dried overnight in the drier at 40° C., whereupon the toner is ground in the mortar and then subjected to fluorescent X-ray measurement. Note that the adhesion rate was determined using the following equation. This series of processes is shown in FIG. 9.

Adhesion rate (%)=(remaining additive amount following ultrasonic treatment (parts)/remaining additive amount prior to ultrasonic treatment (parts))×100

At least one type of the inorganic microparticles described above is preferably constituted by hydrophobic microparticles subjected to hydrophobicity treatment.

Examples of the hydrophobicity treatment agent include: a silane compound such as dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris (β-methoxyethoxy) silane, γ-methacryloxypropyltrimethoxysilane, vinyltriacetoxysilane, divinyldichlorosilane, dimethylvinylchlorosilane, octyltrichlorosilane, decyltrichlorosilane, nonyltrichlorosilane (4-isopropylphenyl) trichlorosilane, (4-t-butylphenyl) trichlorosilane, dibenzyldichlorosilane, dihexyldichlorosilane, dioctyldichlorosilane, dinonyldichlorosilane, didecyldichlorosilane, didodecyldichlorosilane, dihexadecyldichlorosilane, (4-t-butylphenyl) octyldichlorosilane, dioctyldichlorosilane, didecenyldichlorosilane, dinonecyldichlorosilane, di-2-ethylhexyldichlorosilane, di-3, 3-dimethylpentyldichlorosilane, trihexylchlorosilane, trioctylchlorosilane, tridecylchlorosilane, dioctylmethylchlorosilane, octyldimethylchlorosilane, (4-isopropylphenyl) diethylchlorosilane, isobutyltrimethoxysilane, methyltrimethoxysilane, octyltrimethoxysilane, trimethoxy (3, 3, 3-trifluoropropyl) silane, hexamethyldisilazane, hexaethyldisilazane, diethyltetramethylsilazane, hexaphenyldisilazane, hexaethyldisilazane, diethyltetramethylsilazane, hexaphenyldisilazane, or hexatolyldisilazane; a silicone oil such as dimethyl silicone oil, methylphenyl silicone oil, chlorophenyl silicone oil, methylhydrogen silicone oil, alkyl modified silicone oil, fluorinated silicone oil, polyester modified silicone oil, alcohol modified silicone oil, amino modified silicone oil, epoxy modified silicone oil, epoxy/polyester modified silicone oil, phenol modified silicone oil, carboxyl modified silicone oil, mercapto modified silicone oil, acryl/methacryl modified silicone oil, and α-methylstyrene modified silicone oil; another silylating agent; a silane coupling agent having a fluoroalkyl base; an organic titanate coupling agent; an aluminum coupling agent; and so on.

By performing treatment using an organic silane compound, the toner achieves excellent environmental stability, and at the same time, increases in non-electrostatic adhesion can be suppressed even after the external additive has become embedded in the toner parent body particles to a certain extent. Further, an effect can be obtained as long as one type of the added inorganic microparticles is subjected to hydrophobicity treatment, but when two or more types are subjected to hydrophobicity treatment, a further stabilizing effect is obtained, which is preferable.

Next, the magnetic carrier used in the two-component developer will be described in detail.

A widely used magnetic carrier is constituted by magnetic core particles provided with a coated layer as needed.

A well-known magnetic material is used as the core particle, for example a ferromagnetic metal such as iron, cobalt, or nickel, an alloy or compound of magnetite, hematite, ferrite and so on, or similar. Examples of the resin used for the coated layer include polyolefin resin (for example, polyethylene, polypropylene, chlorinated polyethylene, and chlorosulfonated polyethylene), polyvinyl and polyvinylidene resins (for example, polystyrene, acrylic resin (for example, polymethylmethacrylate), polyacrylonitrile, polyvinyl acetate, polyvinyl alcohol, polyvinyl butyral, polyvinyl chloride, polyvinyl carbazole), polyvinyl ether and polyvinyl ketone, a vinyl chloride/vinyl acetate copolymer, a styrene/acrylic copolymer, a silicon resin such as a straight silicon resin made of an organosiloxane bond or modified products thereof (for example, products modified by alkydresin, polyester, epoxyresin, polyurethane, and so on), fluororesins (for example, polytetrafluoroethyelene, polyvinyl fluoride, polyvinylidene fluoride, and polychlorotrifluoroethylene), polyamide, polyester (for example, polyethylene terephthalate), polyurethane, polycarbonate, amino resins (for example, urea/formaldehyde resin), and epoxy resins.

Of these resins, acrylic resins, silicon resins or modified products thereof, and fluorine resins are preferable for preventing toner spending, and silicon resins or modified products thereof are particularly preferable in this respect. A conventional method may be employed as the coated layer formation method, whereby the resin is coated onto the surface of the core particles serving as the magnetic material through spraying, immersion, or similar.

Microparticles may be added to the coated layer to adjust the carrier resistance of the magnetic carrier and so on. The microparticles dispersed through the coated layer preferably have a particle diameter of approximately 0.01 to 5.0 μm. Preferably, between 2 and 30 parts by weight, and more preferably between 5 and 20 parts by weight, of the microparticles are added to 100 parts by weight of the coating subject resin. Well-known microparticles may be used, for example a metal oxide such as silica, alumina, or titania, or a pigment such as carbon black.

The volume average particle diameter of the magnetic carrier having the constitution described above is preferably no more than 50 μm. By using a magnetic carrier having a volume average particle diameter of no more than 50 μm, the magnetic carrier surface area per unit weight increases, enabling an increase in the probability of the replenishing toner contacting the magnetic carrier.

A specific example of developer creation will now be described.

First, 100 parts of a polyester resin A (softening point 106° C., Tg 62° C.) and 7 parts of carbon black were mixed together by a Henschel mixer (manufactured by Mitsui Miike Corporation), and then melt-kneaded by a Bus Co. Kneader (manufactured by Bus Corporation) set to 120° C. After cooling, the kneaded mixture was ground by a grinder using a turbo-mill (manufactured by Turbo Kogyo Co., Ltd.) and classified using an air classifier to obtain a black parent body toner A having a volume average particle diameter of 6.69 μm and an area/weight ratio of 2.34 $m^2/g$.

1.0% by weight of TG-810G (manufactured by Cabot Corporation, BET area-weight ratio 230 $m^2/g$) and 0.8% by weight of X-24 (manufactured by Shin-Etsu Chemical Co., Ltd., particle diameter 50 μm), serving as silica, and 0.5% by weight of MT-500B (manufactured by Tayca Corporation, average particle diameter 0.03 to 0.05 μm) serving as titania were added to 100 parts of the parent body toner A and mixed thoroughly in a Henschel mixer to obtain an electrophotographic toner A.

Next, 100 parts of the polyester resin A (softening point 106° C., Tg 62° C.), 7 parts of carbon black, and 1.5 parts of a zinc compound of salicylic acid were mixed by a Henschel mixer (manufactured by Mitsui Miike Corporation), and then melt-kneaded by a Bus Co. Kneader set to 120° C. After cooling, the kneaded mixture was ground by a grinder using a turbo-mill and classified using an air classifier to obtain a black parent body toner B having a volume average particle diameter of 6.62 μm and an area/weight ratio of 2.35 $m^2/g$.

1.0% by weight of TG-810G (manufactured by Cabot Corporation, BET area-weight ratio 230 $m^2/g$) and 1.8% by weight of AEROSIL RX50 (manufactured by Nippon Aerosil Co., Ltd., BET area-weight ratio 50 $m^2/g$), serving as silica, and 0.5% by weight of MT150 (manufactured by Tayca Corporation, BET area-weight ratio 65 $m^2/g$) serving as titania were added to 100 parts of the parent body toner B and mixed thoroughly in a Henschel mixer to obtain an electrophotographic toner B.

The toner A and toner B were mixed with an FPC-300CL carrier (manufactured by Powder Tech Corporation, volume average particle diameter 55 μm) to obtain a developer A and a developer B. Upon application of the deteriorated toner testing method described above, the developer A maintained $\mu\mathbf{0}(t) \geqq \mu\mathbf{1}(t)$, while the developer B passed the equilibrium state of $\mu\mathbf{0}(t) < \mu\mathbf{1}(t)$ and converged at an electrostatic charge distribution at peak time. Image evaluation was performed by introducing the respective developers, adjusted to a toner concentration of 7%, into the developing apparatus 61.

Here, the adjustment of a value obtained when a value of a local flow speed Vlocal of the developer moving within the developing container 65 is divided by a value of an average flow speed Vaverage when the developer performs one circuit of the developing container 65 in the developing apparatus 61 will be described.

First, a method of measuring the flow speed of the developer will be described.

Figure 10:
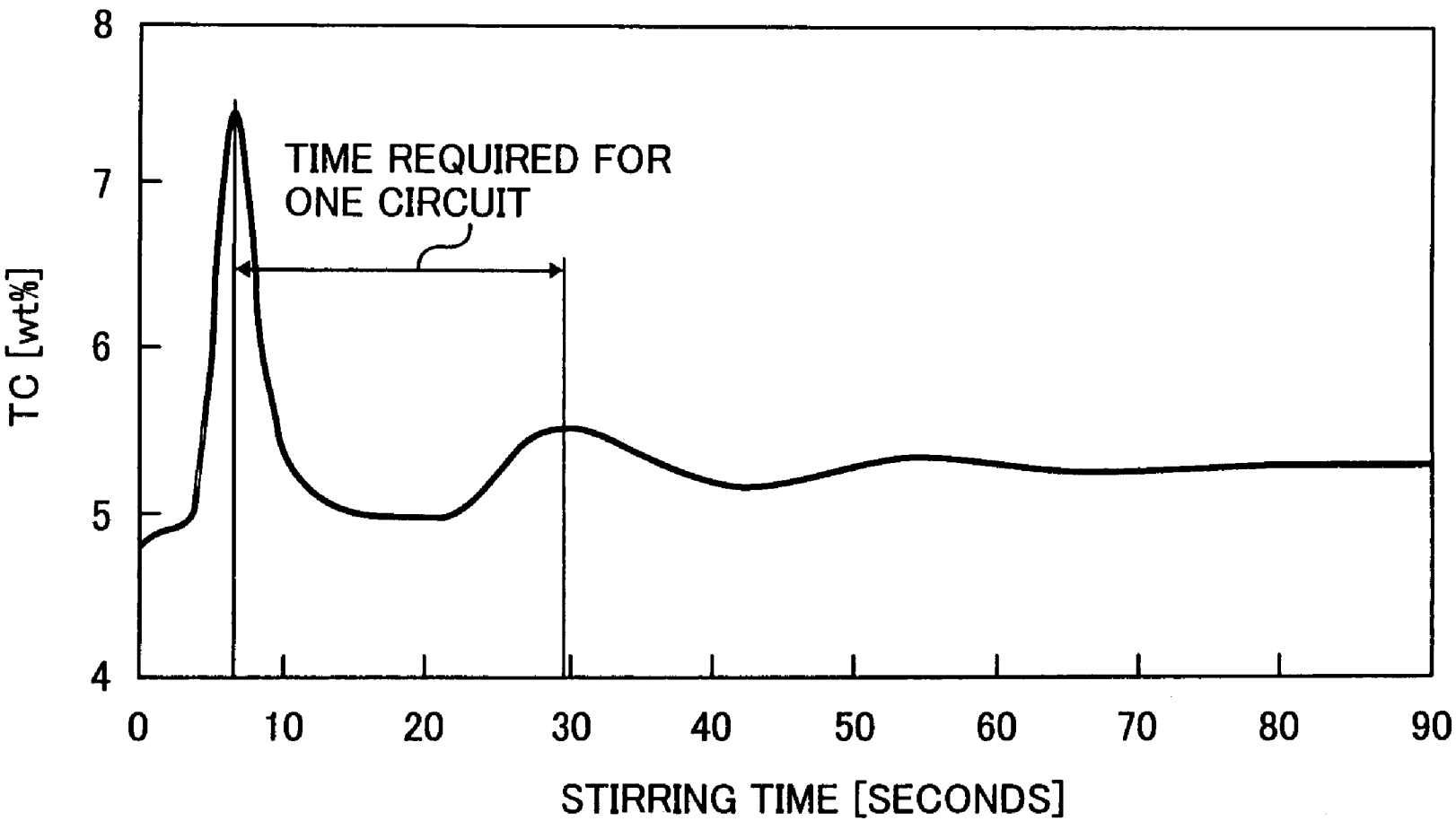
FIG. 10 is a diagram showing an example of the output of a toner concentration sensor in this embodiment.

As shown in FIG. 10, when the output of the individual toner concentration sensors 75 is checked after a fixed amount of replenishing toner is supplied and stirred, the temporal transition of the toner in a certain position is obtained, and hence the flow speed of an average flow speed component (the peak position of a waveform) is determined. This is referred to as the average flow speed Vaverage.

Figure 12:
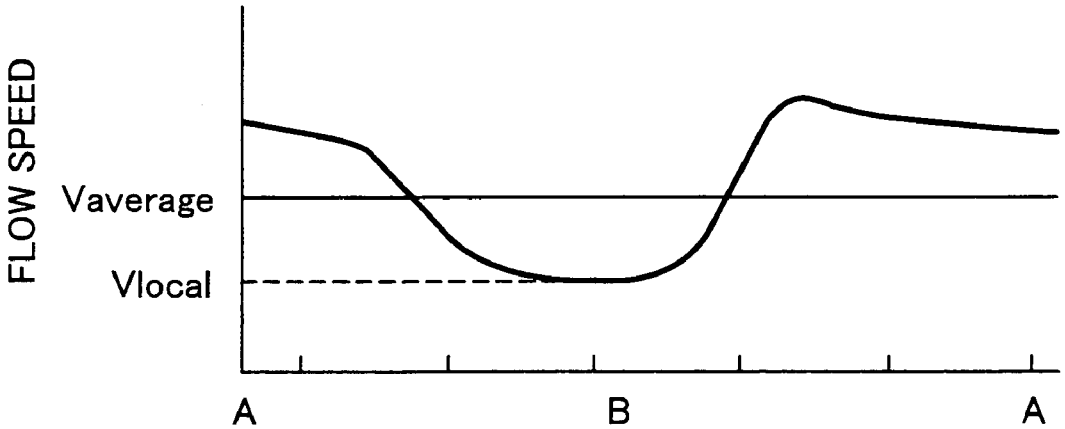
FIG. 12 is a pattern diagram showing a developer flow speed calculated on the basis of the value output from the toner concentration sensor in this embodiment.

The average flow speed Vaverage of the developer during one circuit of the developing container 65 is determined by dividing the length of the developer conveyance path by the time from the peak of the first circuit to the peak of the second circuit. Meanwhile, the flow speed Vlocal in the transfer portion from the replenishment side stirring chamber 86 to the development side stirring chamber 87 (see FIG. 3) is determined from the time difference between the waveform peaks of the toner concentration sensor 75 disposed in the downstream portion of the replenishment side stirring chamber 86 and the toner concentration sensor 75 disposed in the upstream portion of the development side stirring chamber 87, together with the distance between these sensors. FIG. 12 is a pattern diagram of the developer flow speed based on these calculation results.

Figure 11:
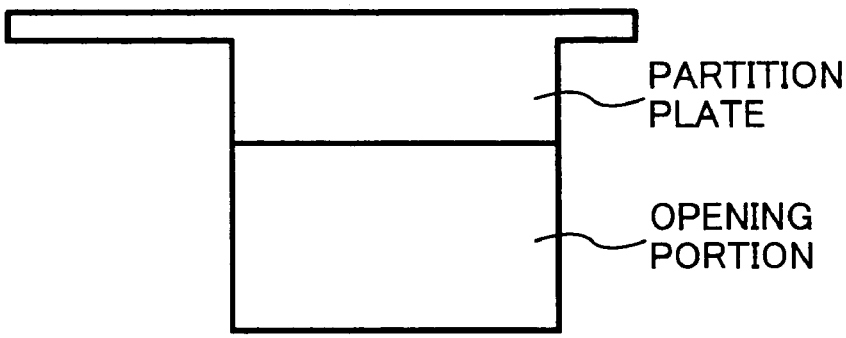
FIG. 11 is a view showing the schematic constitution of a transmission regulating member used in this embodiment.

In this embodiment, the opening portion of the transfer portion of the developing apparatus 61 has an opening area of 832 $mm^2$ (width 32 mm×height 26 mm). As shown in FIG. 11, a transmission regulating member 78 (see FIG. 3) is attached to a ceiling portion of the opening portion in a plate form which serves as an extension of the partition plate 80 between the replenishment side stirring chamber 86 and development side stirring chamber 87, and by narrowing the opening area, the local flow speed in the developing container 65 is adjusted, as a result of which the value of Vlocal/Vaverage is adjusted.

The behavior of the developer in a position in front of the transfer portion of the developing apparatus 61 (a location in which the developer is compacted), having a narrowed opening area as described above, will now be described.

When the opening area of the transfer portion is reduced, the amount of developer that can pass through the transfer portion decreases, and hence the developer contacts the ceiling lid of the replenishment side stirring chamber 86 from a position approximately ⅓ of the way downstream of the replenishment side stirring chamber 86, or in other words the developer becomes lodged around the entire 360-degree circumference of the replenishment side stirring screw 66. At this time, the following two problems may occur.

Firstly, when the replenishing toner enters the compacted area without being completely dispersed, the developer may become packed and be conveyed as is, without being dispersed. Secondly, a part of the developer (particularly in the corners of the stirring chamber which are not swept by the wings of the screw) may form a layer which does not move even when the screw rotates such that the developer does not circulate. When the apparatus is operated after a long period of inactivity, for example, and the developer forming the immobile layer is moved by reducing the high density of the developer, problems such as unevenness in the developer and the toner concentration may arise. The developer does not transmit visible light, and hence the internal flow state cannot be observed using visible light. Hence, a visualization technique using X-rays was employed to check the flow state of the developer in the interior of the developing container 65.

To check the flow state, an X-ray penetration image observation apparatus H3150 (manufactured by Toshiba IT & Control Systems Corporation) was used, and tungsten particles having a substantially equal particle diameter of 50 μm to the carrier particle diameter were used as a tracer for learning the behavior of the developer. Tungsten has a greater absorptance than the carrier (iron oxide) in the developer, and therefore appears blacker than its periphery when observed using penetration X-rays. Furthermore, the amount of tracer particles is sufficiently small to ensure that the tracer exhibits identical behavior to the peripheral developer powder, and hence, by observing the flow state of the tracer particles, the behavior of the developer can be visualized. When conveyed by screw, the tracer particles and powder particles exhibit substantially identical behavior even at a density difference of twenty times or more.

A small amount of tracer was added to the developer behavior observation location using a spatula and taking care not to disturb the flow. The lid of the developer stirring chamber was closed gently and the chamber was placed in the apparatus. The developer behavior during rotation of the screw was then visualized using X-rays. As a result, it was found that the tracer which infiltrated the compacted area was dispersed similarly to a non-compacted area (in which the developer level is positioned slightly above the shaft of the screw) from the toner replenishment position of the replenishment side stirring chamber 86 to the vicinity of the central portion of the replenishment side stirring chamber 86. It was also possible to confirm that, with the screw employed during this investigation, no immobile layer was generated.

Further, the developer pump pole of the magnetic roller body in the developing roller 68 was modified to adjust the dynamic torque of the developing roller 68. The dynamic torque of a developing roller (A) in a normal state was 0.61 kgf·cm, while the dynamic torque of a developing roller (B) having reduced frictional sliding force at the doctor portion was 0.42 kgf·cm. In a developing apparatus comprising the developing roller (A), the value of Vlocal/Vaverage in the developing apparatus not attached with the partition plate 80 is 1. When the opening area is set at 184 $mm^2$ by the partition plate 80, the value of Vlocal/Vaverage in the developing apparatus was 0.62.

Image stability was checked by performing an Evaluation 1 and an Evaluation 2, to be described below, in the combinations shown in FIG. 13.

Long-term image quality stability was evaluated as Evaluation 1. Continuous copying was performed on an image chart area of 5% in an RH environment having a temperature of 20° C. and a humidity of 50%, an RH environment having a temperature of 30° C. and a humidity of 80%, and an RH environment having a temperature of 10° C. and a humidity of 30%. Five lattice-shaped test charts were output every 1000 sheets, and the long-term image quality stability was evaluated according to the solid uniformity of each test chart up to 10,000 sheets. The solid uniformity was measured by a Macbeth densitometer, and temporal solid irregularity was evaluated according to the ratio between in-plane density irregularity and the initial image. In-plane irregularity was denoted by a circle when IDmax−IDmin was at least 0 and less than 0.05, by a triangle when IDmax−IDmin was at least 0.05 and less than 0.10, and by a cross when IDmax−IDmin was at least 0.10. The allowable range was set to less than 0.10. Temporal irregularity was denoted by a circle when a maximum variation value from an initial IDaverage was at least 0 and less than 0.10, by a triangle when the maximum variation value from the initial IDaverage was at least 0.10 and less than 0.20, and by a cross when the maximum variation value from the initial IDaverage was at least 0.20. The allowable range was set to less than 0.10. Also, surface staining was evaluated visually on each sample, and marked with a circle when not visible, a triangle when within an allowable range, and a cross when obvious.

Stability during toner replenishment was evaluated as Evaluation 2. A white original was subjected to continuous copying in an RH environment having a temperature of 10° C. and a humidity of 30%. Twenty black solid images were output after 2000 sheets, 5000 sheets, and 10,000 sheets respectively, and surface staining on a single white image copied immediately after output of the twenty black solid images was evaluated. The surface staining was evaluated with a circle when not visible, a triangle when within an allowable range, and a cross when obvious. FIG. 14 shows the evaluation results for each combination.

As is evident from the results of the above evaluations, by constituting the developing apparatus to have an area which satisfies a relationship of 0.6<Vlocal/Vaverage<0.9 and to be capable of maintaining the relationship between the electrostatic charge distribution peak position $\mu 0$ (t) of the toner in the external force imparting developer and the electrostatic charge distribution peak position $\mu 1$ (t) of the replenishing toner at $\mu 0$ (t)≧$\mu 1$ (t), a developing apparatus, process cartridge, and image forming apparatus having excellent image stability and long-term high image quality in any environment and under any conditions can be provided.

According to the first embodiment described above, by constituting the developing apparatus to have an area which satisfies a relationship of 0.6<Vlocal/Vaverage<0.9 and to be capable of maintaining the relationship between the electrostatic charge distribution peak position $\mu 0$ (t) of the toner in the external force imparting developer and the electrostatic charge distribution peak position $\mu 1$ (t) of the replenishing toner at $\mu 0$ (t)≧$\mu 1$ (t), a developing apparatus, process cartridge, and image forming apparatus having excellent image stability and long-term high image quality in any environment and under any conditions can be provided.

Second Embodiment

The image forming-apparatus according to this embodiment is substantially identical to the copying apparatus shown in FIG. 1 and described in the above first embodiment, and therefore repeated description has been omitted. FIGS. 2 to 4 are also applied to this embodiment similarly, and hence repeated description thereof has also been omitted. Only the features of this embodiment will be described below.

In this embodiment, an experiment was conducted using a carrier having a volume average particle diameter of 35 μm and a toner having a volume average particle diameter of 6 μm, under a toner concentration of 7 wt %. The method of measuring the flow speed of the developer in this experiment is substantially identical to the measurement method of the first embodiment, but in this embodiment, as shown in FIG. 11, when the opening area was narrowed by attaching the transmission regulating member 78 to the ceiling portion in a plate form serving as an extension of the partition plate 80 between the replenishment side stirring chamber 86 and development side stirring chamber 87, the opening area was set at 185 $mm^2$. The local flow speed in the developing apparatus at this time is as shown in FIG. 12, and the value of the flow speed Vlocal/Vaverage at this time was measured at 0.62.

Note that the behavior of the developer in a position in front of the transfer portion of the developing apparatus 61 (a location in which the developer is compacted), having a narrowed opening area as described above, is as described in the first embodiment, and hence repeated description thereof has been omitted.

Figure 15:
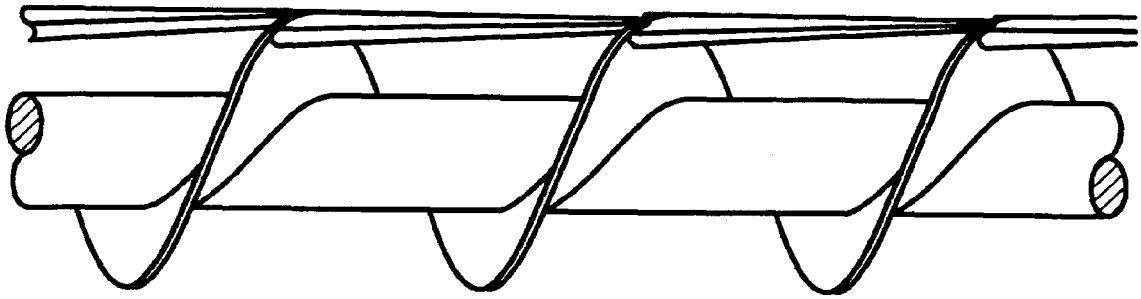
FIG. 15 is a view showing the constitution of a screw according to a second embodiment of the present invention.
Figure 16A:
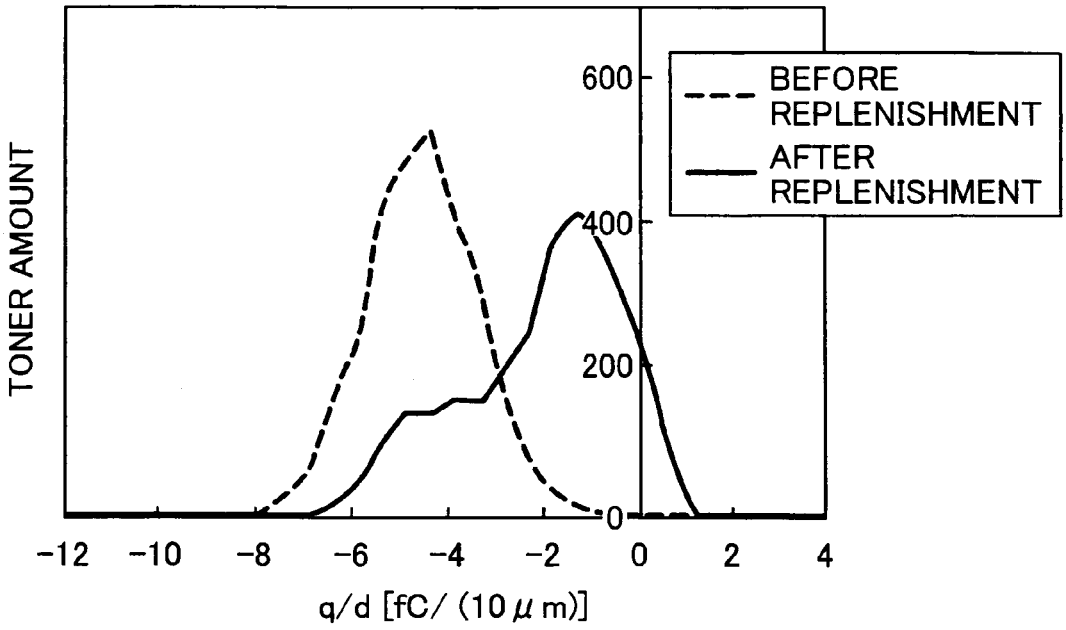
FIGS. 16A and 16B are views showing experiment results of this embodiment.
Figure 16B:
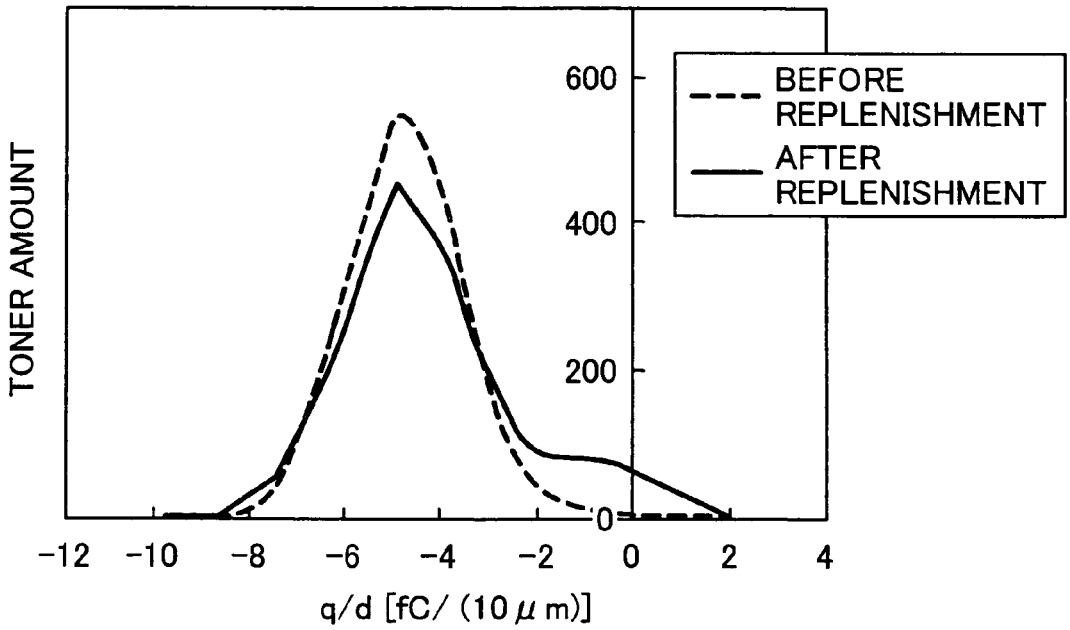

FIG. 15 shows a screw used in this embodiment, and FIGS. 16A and 16B show experiment results. FIG. 16A shows the results of a comparative example, and FIG. 16B shows the results of this embodiment.

The screw used in this embodiment is a spiral screw having a pitch of 25 mm, an outer diameter of 20 mm, and a shaft diameter of 8 mm, and comprises a single plate-form member connected to the outer peripheral portion of the screw wings in the length direction.

Meanwhile, in the comparative example, the outer diameter of the screw wings was made narrower than the other parts at the downstream end portion of the screw in the replenishment side stirring chamber, and it was learned that in this case, a slight immobile layer was generated in the area of an angle formed by the ceiling lid and the side wall on the outer side of the replenishment side stirring chamber. Hence, it was learned that the comparative example is not suited to a combination with a condition in which the compacted area is actively used, as in this embodiment.

Next, a method of checking the charge build-up performance of the toner under the conditions of this embodiment will be described.

1 g of replenishing toner is supplied to the most upstream portion of the replenishment side stirring chamber. The screw is rotated at a predetermined speed, and when the peak of the replenishing toner flows into the replenishment side stirring chamber, the electrostatic charge distribution of the developer directly after the transfer portion is measured. FIG. 16B shows the results thereof.

Note that these graphs only show the effect of the developer transmission regulating means and are therefore the results of measurement performed on a simple stirring apparatus in which the developing roller and doctor blade are removed from the developing machine (i.e. comprising only the replenishment side stirring chamber, development side stirring chamber, screw, partition plate, and developer transmission regulating means). In comparison with the results shown in FIG. 16B, in which the developer transmission regulating means are not used, the electrostatic charge build-up is clearly more advanced and the amount of uncharged toner is extremely small. In the actual developing apparatus, the frictional sliding force of the doctor blade is added, and hence a sufficient electrostatic charge build-up is obtained. Next, these conditions were applied to an actual development unit and a print test was performed.

As a result, even when toner replenishment was performed under harsh conditions (during solid image development), the replenishing toner was sufficiently dispersed and charged before reaching the development side stirring chamber, and image formation was performed favorably with no surface staining and toner scattering.

Third Embodiment

Figure 17B:
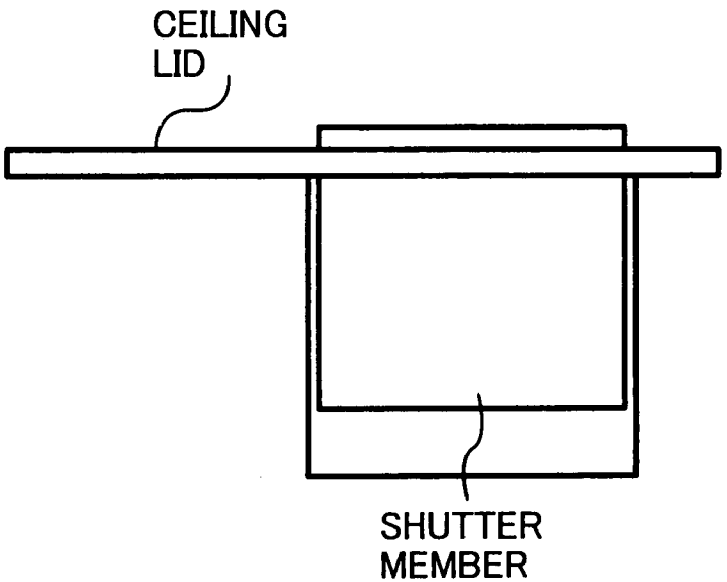
FIGS. 17A and 17B are views illustrating a shutter member according to a third embodiment of the present invention.
Figure 17A:
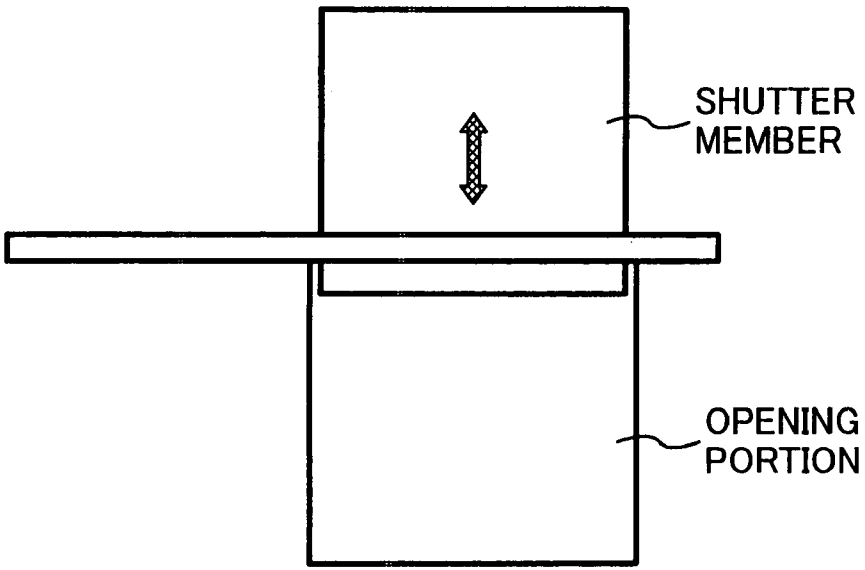

As shown in FIGS. 17A and 17B, in this embodiment, a shutter member which is capable of controlling the opening sectional area of the transfer portion between the replenishment side stirring chamber and development side stirring chamber was used as the developer transmission regulating member. The shutter member is a plate-form member which is inserted downward from the ceiling of the transfer portion between the replenishment side stirring chamber and development side stirring chamber, and by driving the shutter member vertically using drive control means not shown in the drawing, the opening area of the transfer portion can be varied such that frictional sliding force can be applied appropriately according to the charging state of the developer. Note that FIG. 17A shows the opening portion of the shutter member in an open state, while FIG. 17B shows the opening portion in a substantially closed state.

The developing machine used in this embodiment comprises a toner concentration sensor (magnetic permeability sensor) and an image density sensor for sensing the image density of a reference toner image formed on the photosensitive body. When the toner concentration is detected at a predetermined value or greater and the image density of the reference toner image decreases below a predetermined level (in other words, when the electrostatic charge is small in relation to the toner concentration), the shutter member of the transfer portion is driven in a direction which reduces the opening portion area. As the shutter moves in the closing direction, the developer gathers upstream of the shutter in the conveyance direction, leading to an increase in the frictional sliding force applied to the developer. As a result, electrostatic charge build-up is promoted at the same time as dispersal of the replenishing toner. After the electrostatic charge has been built up sufficiently, or during a continuous image forming process in which the image area ratio is small and almost no replenishing toner is required, there is no need to raise the electrostatic charge further, and hence the shutter member is driven to widen the opening portion area, thereby preventing unnecessary stress from being applied to the developer.

It was found by the four present inventors that when this opening area control was performed such that a relationship of $$0.6<V1/V2<1$$

was established between an average flow speed V2 of the developer over one circuit of the developing machine and a flow speed V1 of the developer from the downstream end portion of the replenishment side stirring chamber to a position immediately after transfer into the development side stirring chamber, favorable image formation could be performed without increased deterioration of the developer due to excessive stress and without pumping defects caused by a lack of developer in the development side stirring chamber.

Note that at V1/V2<0.6, the stress applied to the developer is excessive, leading to an increase in the stirring torque of the developing machine and deterioration of the toner, and hence V1/V2<0.6 is inappropriate. On the other hand, at V1/V2>1, the developer does not gather in front of the transfer portion, and instead the developer level in other locations rises relatively. When the developer level rises at the toner replenishment position, for example, the replenishing toner is not mixed into the developer adequately, leading to an unfavorable dispersal characteristic.

Fourth Embodiment

Figure 18B:
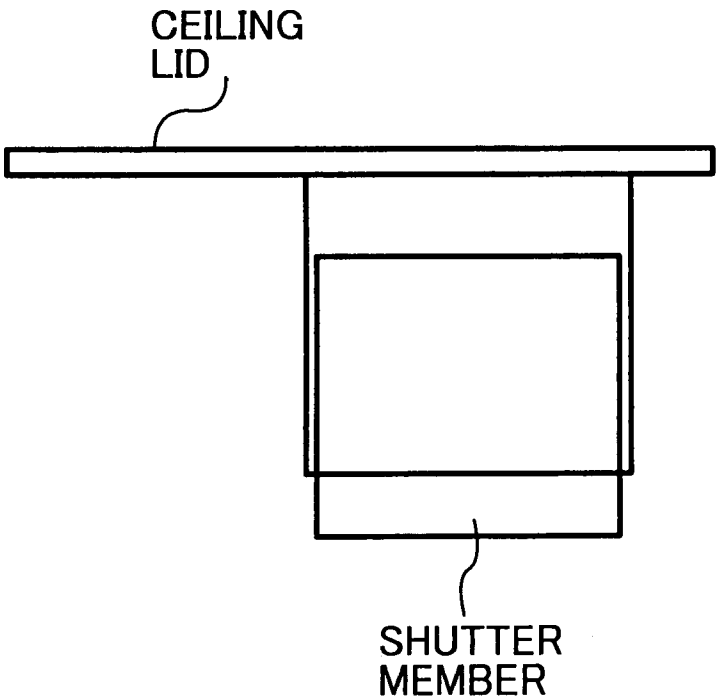
FIGS. 18A and 18B are views illustrating a shutter member according to a fourth embodiment of the present invention.
Figure 18A:
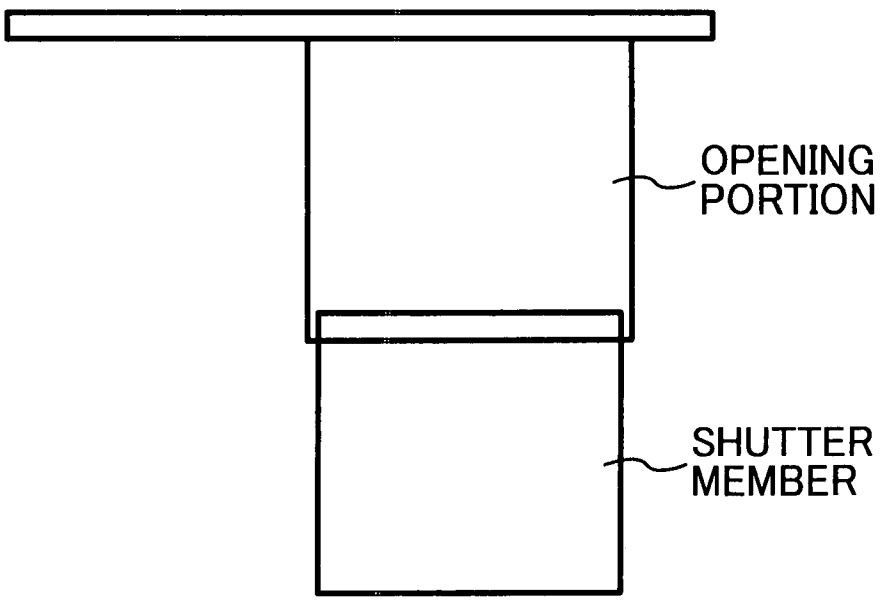

In this embodiment, the same developing apparatus, apart from the transfer portion, as that of the third embodiment is used and, as shown in FIGS. 18A and 18B, the shutter member is a plate-form member protruding from the bottom face of the transfer portion between the replenishment side stirring chamber and development side stirring chamber in the direction of the ceiling. By moving the shutter member vertically using drive control means not shown in the drawing, the opening portion area is varied.

With the constitution of this embodiment, favorable image formation with no toner scattering and surface staining was possible.

Fifth Embodiment

Figure 19B:
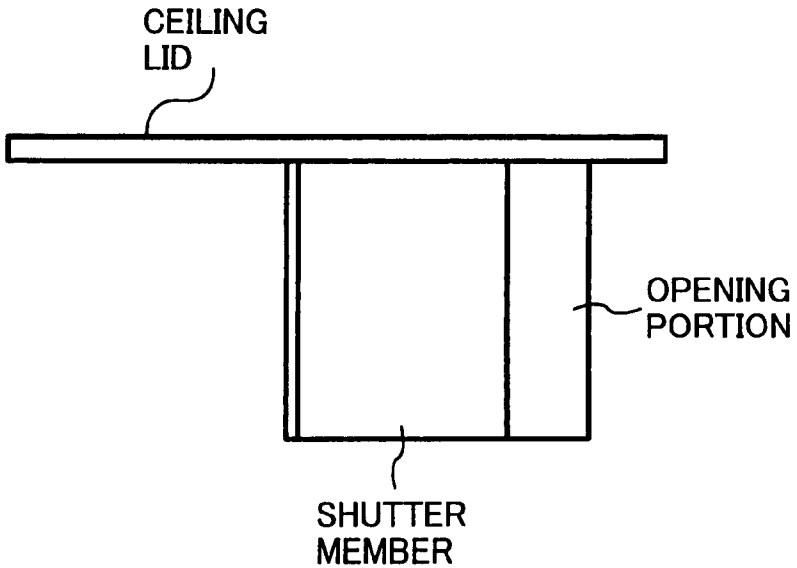
FIGS. 19A and 19B are views illustrating a shutter member according to a fifth embodiment of the present invention.
Figure 19A:
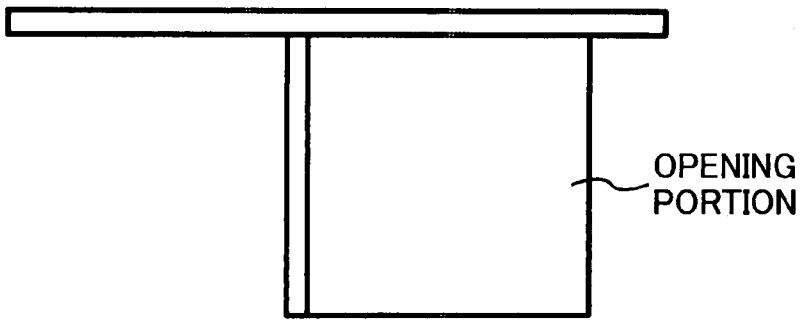

In this embodiment, the same developing apparatus, apart from the transfer portion, as that of the third embodiment is used and, as shown in FIGS. 19A and 19B, the shutter member is a plate-form member capable of sliding horizontally across the transfer portion between the replenishment side stirring chamber and development side stirring chamber. By moving the shutter member to the left and right using drive control means not shown in the drawing, the opening portion area is varied.

With the constitution of this embodiment, favorable image formation with no toner scattering and surface staining was possible.

Sixth Embodiment

Figure 20B:
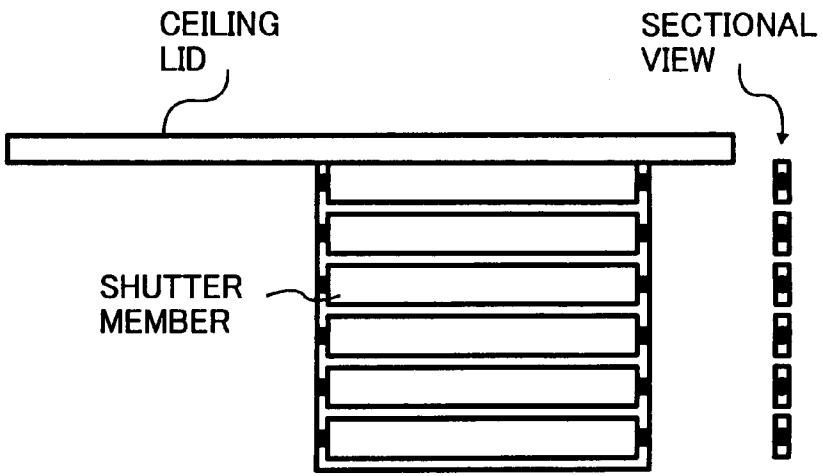
FIGS. 20A and 20B are views illustrating a shutter member according to a sixth embodiment of the present invention.
Figure 20A:
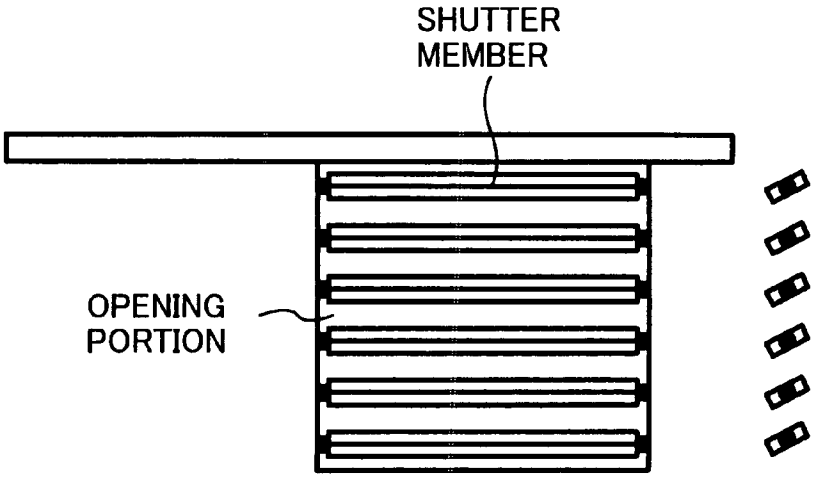

In this embodiment, the same developing apparatus, apart from the transfer portion, as that of the third embodiment is used and, as shown in FIGS. 20A and 20B, the shutter member is constituted by a plurality of plate-form members in the form of blinds provided in parallel at the transfer portion between the replenishment side stirring chamber and development side stirring chamber. By varying the angle of the individual shutter members in conjunction to an identical orientation using drive control means not shown in the drawing, the opening portion sectional area is varied. Note that here, the employed plate-form members have a sufficiently small width to prevent interference with the screw wings even when the plate-form members of the individual shutters are horizontal. In this embodiment, members having a width of 4 mm were used.

With the constitution of this embodiment, favorable image formation with no toner scattering and surface staining was possible.

According to the second to sixth embodiments described above, the flow speed from the downstream end portion of the replenishment side stirring chamber to a position immediately after transfer into the development side stirring chamber is regulated, causing the developer to gather in the replenishment side stirring chamber. As a result, the frictional sliding force applied to the developer increases, promoting dispersal of the replenishing toner and charging of the toner simultaneously. By varying the sectional area of the developer path according to the charging state of the developer in the developing apparatus, a frictional sliding force which is neither excessive nor insufficient can be applied, and developer deterioration caused by the application of excessive frictional sliding force can be suppressed.

Seventh Embodiment

In this embodiment, an experiment was conducted after changing the screw pitch of a part 50% on the downstream side of the replenishment side stirring chamber (25% in relation to the entire developer conveyance path) to 12.5 mm (the screw pitch in the other parts being 37 mm). At this time, the local flow speed in the developing machine is as shown in FIG. 12, and when the flow speed ratio Vlocal/Vaverage was measured under these conditions, a value of 0.72 was obtained. As for the behavior of the developer under these conditions, in the vicinity of the opening portion through which the developer passes, with the reduced screw pitch, the flow speed of the developer becomes slower locally, and therefore the developer contacts the ceiling portion of the developing machine, entering a compacted state. The developer gathers in the location having the slow flow speed and enters a compacted state, enabling promotion of electrostatic charge build-up. The area of the conveyance path in which this state is generated will be referred to as a slow flow path.

Having checked the appropriate value of the flow speed ratio Vlocal/Vaverage, the following result was obtained.

$$0.6<\text{Vlocal}/\text{Vaverage}<0.9$$

When the ratio exceeds the upper limit, the developer does not enter a compacted state and the electrostatic charge build-up promoting effect does not occur. Conversely, when the ratio falls below the lower limit, the stress applied to the developer becomes excessive, leading to an increase in the stirring torque of the developing machine and deterioration of the toner, and hence Vlocal/Vaverage<0.6 is inappropriate.

Note that in this embodiment also, the method of checking the electrostatic charge build-up characteristic of the toner under the conditions of this embodiment is applied in an identical fashion to that described in the second embodiment, and hence repeated description thereof has been omitted.

Eighth Embodiment

In this embodiment, the same developing apparatus, apart from the screw of the replenishment side stirring chamber, as that of the seventh embodiment is used, and an experiment was conducted after increasing the shaft diameter of the screw in a part 50% on the downstream side of the replenishment side stirring chamber. By increasing the shaft diameter, the developer storage capacity decreases in the corresponding part, and as a result the developer enters a compacted state, enabling promotion of the electrostatic charge build-up. This area serves as a slow flow path.

With the constitution of this embodiment, favorable image formation without toner scattering and surface staining was possible.

Ninth Embodiment

In this embodiment, the same developing apparatus, apart from the screw of the replenishment side stirring chamber, as that of the seventh embodiment is used, and an experiment was conducted after making the part of the screw located 50% on the downstream side of the replenishment side stirring chamber into a triple-threaded screw (the other parts being double-threaded). By making the screw triple-threaded in this manner, the developer flow speed decreases, and as a result, the developer enters a compacted state such that electrostatic charge build-up can be promoted. This area serves as a slow flow path.

With the constitution of this embodiment, favorable image formation without toner scattering and surface staining was possible. Moreover, the developer can be compacted after the replenishing toner is supplied and before the developer is supplied to the developing roller, and hence electrostatic charge build-up can be promoted even more reliably. Also, by reducing the flow speed on the downstream side of the replenishment side stirring chamber, toner surface sliding during toner replenishment is less likely to have an effect.

In this embodiment, the experiment was conducted at a dynamic torque of 100 kgf during unit driving of the developer carrier, and at a dynamic torque of 200 kgf during driving of the entire developing apparatus. In the present invention, the developer is charged when supplied to the developing roller and regulated by the doctor, and at the compacted portion before being supplied to the roller. Extremely great stress is applied to the developer during doctor regulation, and it is therefore desirable that the stress of the doctor portion be lowered as far as possible.

Assuming that the dynamic torque during unit driving of the developer carrier is Tsleeve and the dynamic torque during driving of the entire developing apparatus is Tall, an optimum range of $$0.4<\text{Tsleeve}/\text{Tall}<0.7$$

exists for establishing both reduced stress and the electrostatic charge build-up characteristic. When 0.4>Tsleeve/Tall, electrostatic charge build-up is promoted only at the compacted portion, and hence the charge cannot be raised sufficiently. When Tsleeve/Tall>0.7, excessive stress is applied in relation to the electrostatic charge build-up, expediting deterioration of the developer.

According to the seventh to ninth embodiments described above, when the average flow speed of the developer during one circuit of the developing container is Vaverage and the local flow speed of the developer in the developing container is Vlocal, a relationship of $$0.6<\text{Vlocal}/\text{Vaverage}<0.9$$

is satisfied, and hence the developer gathers in the slow flow speed location and enters a compacted state, enabling promotion of electrostatic charge build-up. When printing is performed with this relationship established, favorable image formation can be performed with no toner scattering and surface staining.

Various modifications will become possible for those skilled in the art after receiving the teachings of the present disclosure without departing from the scope thereof.

What is claimed is:

1. A developing apparatus in which a magnetic brush is formed by magnetically applying a two-component developer, which is constituted by at least a magnetic carrier and a negatively charged toner comprising toner particles and an external additive, onto a developer carrier, and an electrostatic latent image formed on a latent image carrier is made visible by said magnetic brush, said developing apparatus comprising:

stirring means for stirring and dispersing said developer and conveying said developer to a predetermined position within a developing container; and toner replenishing means for replenishing toner that is consumed during development, wherein an area in which a relationship of 0.6<Vlocal/Vaverage<0.9, where Vaverage is an average flow speed of said developer during one circuit of said developing container and Vlocal is a local flow speed of said developer as said developer moves through said developing container, is satisfied exists in said developing container, and said negatively charged toner maintains a relationship of $\mu 0$ (t)≧$\mu 1$ (t) between an electrostatic charge distribution peak position $\mu 0$ (t) of toner in an external force imparting developer and an electrostatic charge distribution peak position $\mu 1$ (t) of said replenishing toner, said relationship being measured in a deteriorated toner testing method.

2. The developing apparatus as claimed in claim 1, wherein a value obtained by dividing a dynamic torque value of said developer carrier by a dynamic torque value of said entire developing apparatus is between 0.4 and 0.7.

3. The developing apparatus as claimed in claim 1, wherein one or more types of silica subjected to hydrophobicity treatment and having an average particle diameter between 30 and 150 nm is used as said external additive.

4. A developing apparatus comprising:

stirring means for stirring and dispersing a two-component developer constituted by a toner and a carrier using two rotatable screws disposed within a developer container, and conveying said two-component developer to a predetermined position; and toner replenishing means for replenishing toner that is consumed during development, wherein, when a developer storage portion on a toner replenishment side is set as a replenishment side stirring chamber and a developer storage portion on a side facing a developer carrier is set as a development side stirring chamber, a flow speed V1 from a down stream end portion of said replenishment side stirring chamber to a position directly after transfer into said development side stirring chamber and an average flow speed V2 of said developer during one circuit of said developer container satisfy a relationship of $$0.6<V1/V2<1.$$

5. The developing apparatus as claimed in claim 4, further comprising developer transmission regulating means for regulating the amount of developer that is conveyed, said developer transmission regulating means being provided at an opening portion through which said developer is transferred from a downstream end portion of said replenishment side stirring chamber in a developer conveyance direction into said development side stirring chamber.

6. The developing apparatus as claimed in claim 4, wherein each of said screws is a spiral screw and comprises a single plate-form member connected to the outer peripheral portion of the screw wings in the length direction.

7. A developing apparatus comprising:

stirring means for stirring and dispersing a two-component developer constituted by a toner and a carrier using two rotatable screws disposed within a developer container, and conveying said two-component developer to a predetermined position;

toner replenishing means for replenishing toner that is consumed during development;

means for detecting a toner concentration of said developer; and means for detecting an image density of a reference toner image formed on an image carrier surface formed with an electrostatic latent image, wherein, when a developer storage portion on a toner replenishment side is set as a replenishment side stirring chamber and a developer storage portion on a side facing a developer carrier is set as a development side stirring chamber, developer transmission regulating means are provided at an opening portion through which said developer is transferred from a downstream end portion of said replenishment side stirring chamber in a developer conveyance direction into said development side stirring chamber, and drive control means are provided for activating said developer transmission regulating means when said toner concentration of said developer is detected to be equal to or greater than a predetermined value by said toner concentration detecting means and said image density of said reference toner image is detected to have fallen below a predetermined level by said image density detecting means, whereby a flow speed V1 from a downstream end portion of said replenishment side stirring chamber to a position directly after transfer into said development side stirring chamber and an average flow speed V2 of said developer during one circuit of said developer container satisfy a relationship of $$0.6<V1/V2<1.$$

8. The developing apparatus as claimed in claim 7, wherein said developer transmission regulating means are constituted by a shutter member capable of varying a sectional area of a transfer portion between said replenishment side stirring chamber and said development side stirring chamber.

9. The developing apparatus as claimed in claim 8, wherein said shutter member is a plate-form member which is inserted downward from a ceiling of said transfer portion, and said opening portion area is varied by moving said plate-form member vertically.

10. The developing apparatus as claimed in claim 8, wherein said shutter member is a plate-form member protruding from a bottom surface of said transfer portion in the direction of a ceiling, and said opening portion area is varied by moving said plate-form member vertically.

11. The developing apparatus as claimed in claim 8, wherein said shutter member is a plate-form member capable of sliding across said opening portion of said transfer portion in a horizontal direction, and said opening portion area is varied by moving said plate-form member left and right.

12. The developing apparatus as claimed in claim 8, wherein said shutter member is constituted by a plurality of plate-form members disposed in parallel in said transfer portion, and said opening portion area is varied by varying an angle of said plate-form members.

13. The developing apparatus as claimed in claim 7, wherein each of said screws is a spiral screw and comprises a single plate-form member connected to the outer peripheral portion of the screw wings in the length direction.

14. A developing apparatus comprising:

stirring means for stirring and dispersing a two-component developer constituted by toner particles and carrier particles using two rotatable screws disposed within a developer container, and conveying said two-component developer to a predetermined position; and toner replenishing means for replenishing toner that is consumed during development, wherein, when a developer storage portion on a toner storage side is set as a replenishment side stirring chamber, a developer storage portion on a side facing a developer carrier is set as a development side stirring chamber, an average flow speed of said developer during one circuit of said developer container is set as Vaverage, and a local flow speed of said developer as said developer moves through said developing container is set as Vlocal, a slow flow path on which a relationship of $$0.6<Vlocal/Vaverage<0.9$$

is established exists within said developing container.

15. The developing apparatus as claimed in claim 14, wherein said slow flow path occupies between 10% and 50% of the entire conveyance path of said developer within said developing apparatus.

16. The developing apparatus as claimed in claim 14, wherein said slow flow path exists in said replenishment side stirring chamber.

17. The developing apparatus as claimed in claim 14, wherein said slow flow path exists on a downstream side of said replenishment side stirring chamber in a developer conveyance direction, including an opening portion through which said developer is transferred into said development side stirring chamber.

18. The developing apparatus as claimed in claim 14, wherein said local flow speed Vlocal of said developer as said developer moves through said developing container is varied so as to satisfy said relationship of $$0.6<Vlocal/Vaverage<0.9$$

by locally varying a screw pitch of said screw.

19. The developing apparatus as claimed in claim 14, wherein said local flow speed Vlocal of said developer as said developer moves through said developing container is varied so as to satisfy said relationship of $$0.6<Vlocal/Vaverage<0.9$$

by locally varying a thickness of a shaft part of said screw.

20. The developing apparatus as claimed in claim 14, wherein said local flow speed Vlocal of said developer as said developer moves through said developing container is varied so as to satisfy said relationship of $$0.6<Vlocal/Vaverage<0.9$$

by locally varying a number of wing threads constituting said screw.

21. The developing apparatus as claimed in claim 14, wherein, when a dynamic torque during unit driving of a developer carrier is Tsleeve and a dynamic torque during driving of said entire developing apparatus is Tall, a relationship of $$0.4<Tsleeve/Tall<0.7$$

is satisfied.

22. The developing apparatus as claimed in claim 14, wherein each of said screws is a spiral screw and comprises a single plate-form member connected to the outer peripheral portion of the screw wings in the length direction.

* * * * *